US009574815B2

(12) United States Patent
Ikeda et al.

(10) Patent No.: US 9,574,815 B2
(45) Date of Patent: Feb. 21, 2017

(54) AIR-CONDITIONING-APPARATUS INDOOR UNIT

(75) Inventors: Takashi Ikeda, Tokyo (JP); Masahiko Takagi, Tokyo (JP); Makoto Kurihara, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 335 days.

(21) Appl. No.: 14/116,143

(22) PCT Filed: Apr. 26, 2012

(86) PCT No.: PCT/JP2012/002870
§ 371 (c)(1),
(2), (4) Date: Nov. 7, 2013

(87) PCT Pub. No.: WO2012/169110
PCT Pub. Date: Dec. 13, 2012

(65) Prior Publication Data

US 2014/0083649 A1 Mar. 27, 2014

(30) Foreign Application Priority Data

Jun. 9, 2011 (JP) ..... 2011-129550

(51) Int. Cl.
*F25D 17/06* (2006.01)
*F24F 1/00* (2011.01)
(Continued)

(52) U.S. Cl.
CPC ..... *F25D 17/06* (2013.01); *F24F 1/0011* (2013.01); *F24F 1/0014* (2013.01);
(Continued)

(58) Field of Classification Search
CPC ..... F24F 13/06; F24F 13/062; F24F 13/072; F24F 13/075; F24F 13/081; F24F 2221/14; F24F 2221/0037; F24F 1/0011
(Continued)

(56) References Cited

U.S. PATENT DOCUMENTS 2,353,826 A * 7/1944 Honerkamp ..... F24F 13/062 29/513
2,362,355 A * 11/1944 Collicutt ..... F24F 13/062 454/228
(Continued)

FOREIGN PATENT DOCUMENTS

CN 1125313 A 6/1996
CN 1086798 C 6/2002
(Continued)

OTHER PUBLICATIONS

Office Action issued Sep. 17, 2015 in the corresponding CN application No. 201280027784.6 (with English translation).
(Continued)

*Primary Examiner* — Frantz Jules
*Assistant Examiner* — Nelson Nieves
(74) *Attorney, Agent, or Firm* — Posz Law Group, PLC

(57) ABSTRACT

Body air outlets of an air-conditioning-apparatus indoor unit each has a substantially trapezoidal shape in plan view and are each defined by a body-air-outlet outer side wall, a body-air-outlet inner side wall, and a pair of body-air-outlet end walls. The body-air-outlet outer side wall is provided with a deflection guide at each of long-side ends thereof. The body-air-outlet end walls are each provided with a sloping guide. The deflection guide has a deflection-guide upper surface that gradually projects toward the body-air-outlet inner side wall in a direction toward a body open face (toward a downstream side) and in a direction toward the
(Continued)

central part of the body air outlet. The sloping guide has a sloping-guide upper surface that gradually projects toward the central part of the body air outlet as the sloping guide extends closer to the body open face (toward the downstream side).

14 Claims, 18 Drawing Sheets

(51) Int. Cl.
*F24F 13/08* (2006.01)
*F24F 13/22* (2006.01)

(52) U.S. Cl.
CPC .... *F24F 13/081* (2013.01); *F24F 2001/0037* (2013.01); *F24F 2013/221* (2013.01)

(58) Field of Classification Search
USPC .... 62/407, DIG. 16; 445/233, 236, 248, 292
See application file for complete search history.

(56) References Cited

U.S. PATENT DOCUMENTS

| | | | | | |
|---|---|---|---|---|---|
| 2,735,352 | A * | 2/1956 | Demuth | F24F 13/062 | 454/310 |
| 2,861,597 | A * | 11/1958 | Gracer | F24F 13/081 | 138/39 |
| 4,458,502 | A * | 7/1984 | Adachi | F24F 1/0011 | 454/299 |
| 4,709,623 | A * | 12/1987 | Roth | B60H 1/00364 | 454/136 |
| 4,995,426 | A * | 2/1991 | Hinden | F24F 13/081 | 138/39 |
| 5,577,958 | A * | 11/1996 | Kumekawa | F24F 13/081 | 454/233 |
| 6,083,101 | A * | 7/2000 | Kaga | F24F 1/0011 | 165/122 |
| 6,206,778 | B1 * | 3/2001 | Smith | F24F 13/06 | 454/292 |
| 6,250,373 | B1 * | 6/2001 | Vecchi | F24F 1/0007 | 165/125 |
| 6,435,963 | B1 * | 8/2002 | Dill | F24F 13/06 | 454/292 |
| 8,636,566 | B2 * | 1/2014 | Gajina | F24F 13/084 | 454/292 |
| 2004/0152411 | A1 * | 8/2004 | Gehring | F24F 13/06 | 454/153 |
| 2005/0223732 | A1 * | 10/2005 | Kim | F24F 1/0011 | 62/298 |
| 2007/0015455 | A1 * | 1/2007 | Knight | F24F 13/06 | 454/292 |
| 2007/0130980 | A1 * | 6/2007 | Han | F24F 1/0011 | 62/262 |
| 2008/0318511 | A1 * | 12/2008 | Becker | F24F 13/06 | 454/306 |
| 2010/0154911 | A1 * | 6/2010 | Yoskowitz | F24F 13/081 | 138/39 |
| 2010/0163209 | A1 * | 7/2010 | Eguchi | F24F 13/081 | 165/41 |
| 2010/0174414 | A1 * | 7/2010 | Takagi | F24F 11/0034 | 700/278 |
| 2010/0192611 | A1 * | 8/2010 | Yamaguchi | F24F 1/0014 | 454/292 |
| 2012/0045338 | A1 * | 2/2012 | Tadokoro | F04D 29/281 | 416/196 R |

FOREIGN PATENT DOCUMENTS

| | | | |
|---|---|---|---|
| CN | 1285862 | C | 11/2006 |
| EP | 2 017 543 | A1 | 1/2009 |
| GB | 2 293 447 | A | 3/1996 |
| JP | 01-244238 | A | 9/1989 |
| JP | 04-043253 | A | 2/1992 |
| JP | 05-322201 | A | 12/1993 |
| JP | 08-121857 | A | 5/1996 |
| JP | 08-254352 | A | 10/1996 |
| JP | 08-285303 | A | 11/1996 |
| JP | 09-014742 | A | 1/1997 |
| JP | 3240854 | B2 | 12/2001 |
| JP | 2004-271114 | A | 9/2004 |
| JP | 2008-275193 | A | 11/2008 |
| JP | 2010-038490 | A | 2/2010 |
| JP | 2010-281539 | A | 12/2010 |
| JP | 2012-078031 | A | 4/2012 |
| WO | 02/14748 | A1 | 2/2002 |

OTHER PUBLICATIONS

Extended European Search Report dated Oct. 28, 2014 in corresponding EP patent application No. 12796655.4 (in English).
Office Action mailed Jul. 15, 2014 issued in corresponding JP patent application No. 2013-519355 (and English translation).
International Search Report of the International Searching Authority mailed Jul. 24, 2012 for the corresponding international application No. PCT/JP2012/002870 (with English translation).
Office Action issued Feb. 4, 2015 in the corresponding AU patent application No. 2012265763.
Office Action issued Mar. 17, 2015 in the corresponding JP patent application No. 2013-519335 (with English translation).
Office Action issued May 17, 2016 in the corresponding JP application No. 2015-117699 (with English translation).
Office Action mailed May 31, 2016 issued in the corresponding Chinese Patent Application No. 201280027784.6 (and English translation).

* cited by examiner

AIR-CONDITIONING-APPARATUS INDOOR UNIT

CROSS REFERENCE TO RELATED APPLICATION

This application is a U.S. national stage application of International Application No. PCT/JP2012/002870 filed on Apr. 26, 2012, the disclosure of which is incorporated by reference.

TECHNICAL FIELD

The present invention relates to an air-conditioning-apparatus indoor unit, and in particular to an air-conditioning-apparatus indoor unit that includes an air inlet provided in a central part thereof and air outlets provided around the air inlet.

BACKGROUND ART

Known indoor units included in ceiling-concealed air-conditioning apparatuses each include a housing embedded in the ceiling and having a square sectional shape, a fan and an air inlet provided in a central part of the housing, and a heat exchanger surrounding the fan. Hence, room air that is taken in substantially upward by the fan is redirected in the fan in such a manner as to flow substantially horizontally toward the periphery. Subsequently, the air is redirected downward after flowing through the heat exchanger, and is blown from air outlets into the room.

In the above case, the airflow is guided and redirected by the inner surface of the housing. Because of the inertia of the airflow, the airflow is not completely redirected, but the speed of the airflow increases in an area near the inner surface of the housing (in an area far from the fan), making the distribution of airflow speed at the air outlets nonuniform.

Accordingly, uniform-airflow-speed means (means that makes the distribution of airflow speed at an air outlet uniform) is disclosed (see Patent Literature 1, for example), in which a deflection guide having a triangular prism shape is provided on the inner surface of the housing; an air-passage wall portion is provided by making a recess in a portion of a wall provided below a heat exchanger and that faces the deflection guide so that the sectional area of the air passage becomes substantially uniform; and an enlarged air passage portion is provided immediately after a downstream end of the deflection guide.

CITATION LIST

Patent Literature

Patent Literature 1: Japanese Patent No. 3240854 (page 4 and FIG. 2)

SUMMARY OF INVENTION

Technical Problem

The uniform-airflow-speed means disclosed by Patent Literature 1 makes the distribution of airflow speed at the air outlet uniform. Therefore, the uniform-airflow-speed means is generally capable of preventing dew formation on an air-directing vane that may occur in cooling and preventing smudging. However, the uniform-airflow-speed means has the following problems.

Herein, smudging refers to staining of the ceiling that may occur because air that has been blown from each end of the air outlet in a long-side direction of the air outlet (corresponding to a direction parallel to each side face of the housing) is blown toward the ceiling while taking in unclean room air.

(a) Although the distribution of airflow speed is made uniform, it cannot be said that the airflow is controlled over the entirety of an area extending in the long-side direction of the air outlet, because the shape of the deflection guide in the long-side direction of the air outlet is not specified. Hence, the airflow speed is relatively low at each long-side end of the air outlet. Consequently, highly humid room air is mixed with the blown air, resulting in possible dew formation.

(b) In a case where the airflow speed at the long-side end of the air outlet is relatively low, when air is blown toward the ceiling with the aid of the air-directing vane, such air immediately collides with the ceiling, compared with air flowing in a mainstream outflow area in a long-side central part of the air outlet. Such air is blown onto the ceiling while taking in unclear room air. Hence, the ceiling may be stained.

(c) To control the airflow at the long-side end of the air outlet, the length of the deflection guide in the long-side direction of the air outlet may become unnecessarily large, increasing the draft resistance in the air passage. Consequently, the load torque of the fan may increase, and the power consumed by the motor may therefore increase.

The present invention is to solve the above problems and to provide an air-conditioning-apparatus indoor unit in which dew formation at long-side ends of each air outlet and smudging are prevented while an energy-saving effect is produced.

Solution to Problem

An air-conditioning-apparatus indoor unit according to the present invention includes:

a box-shaped body including a body top board and a body side board and provided with a body open face at a face opposite the body top board, the body open face serving as a body air inlet;

an air-sending fan provided inside the body;

a heat exchanger provided inside the body in such a manner as to surround the air-sending fan and to extend along the body side board; and a drain pan provided inside the body and below the heat exchanger, wherein the body further includes a plurality of body air outlets provided on a periphery of the body open face and configured to blow out air to an outside of the body, the air having been taken in from the body open face and having flowed through the heat exchanger, wherein the plurality of body air outlets, which are separately provided from one another between the drain pan and the body side board, are each defined by

- a body-air-outlet outer side wall provided along the body side board of the body;
- a body-air-outlet inner side wall that is opposite the body-air-outlet outer side wall and is provided on a side of the drain pan, and body-air-outlet end walls connecting a corresponding one of ends of the body-air-outlet outer side wall and a corresponding one of ends of the body-air-outlet inner side wall, wherein the body-air-outlet outer side wall is provided with deflection guides each provided in a predetermined area extending from a corresponding one of the ends of the body-air-outlet outer side wall on sides of the body-air-outlet end walls toward a central part of the body air outlet in-between the body-air-outlet end walls, and wherein the deflection guides includes deflection upper surfaces gradually extending closer to the body-air-outlet inner side wall in a direction from the end of the body-air-outlet outer side wall on sides of the body-air-outlet end walls toward the central part of the body air outlet and in a direction from an upper end of the body-air-outlet outer side wall toward the body open face.

Advantageous Effects of Invention

The air-conditioning-apparatus indoor unit according to the present invention includes the deflection guides each provided in the predetermined area extending from a corresponding one of the ends of the body-air-outlet outer side wall toward the central part of the body air outlet. Furthermore, the deflection guide includes the deflection-guide upper surface gradually extending closer to the body-air-outlet inner side wall in the direction from the end of the body air outlet toward the central part of the body air outlet and in the direction toward the body open face (corresponding to a direction toward the downstream side in the flow of conditioned air).

That is, in plan view, the deflection-guide upper surface extends closer to the body-air-outlet inner side wall while going away from the body-air-outlet end wall, whereby the width of the air passage (corresponding to a length in a direction perpendicular to the body-air-outlet outer side wall or the body-air-outlet inner side wall) is reduced. Furthermore, in side view, the deflection-guide upper surface extends closer to the body-air-outlet inner side wall while approaching the body open face, whereby the width of the air passage (corresponding to a length in the direction perpendicular to the body-air-outlet outer side wall or the body-air-outlet inner side wall) is reduced.

Hence, regarding the conditioned air that has been blown from the air-sending fan and has flowed into the body air outlet, a portion that has flowed toward the end of the air outlet is guided along the deflection-guide upper surface. In this situation, since the deflection-guide upper surface has the above-described shape, the portion of the conditioned air that has flowed toward the end of the body air outlet is redirected to a direction toward the body open face and a direction from the side of the body-air-outlet outer side wall toward the side of the body-air-outlet inner side wall in a plane perpendicular to the body side board, and also to a direction toward the body open face and a direction from the center side toward the end side of the body air outlet in a plane parallel to the body side board.

Consequently, the speed of the conditioned air increases in an area near the end of the body air outlet, whereby the difference from the speed of the airflow in an area near the central part of the body air outlet is reduced. Accordingly, the distribution of the speed of the conditioned air to be blown is made uniform. Therefore, highly humid room air is prevented from flowing into the area near the end of the body air outlet. Thus, the occurrence of dew formation is prevented.

Moreover, since the conditioned air thus blown includes no portion in which the speed of airflow is low, the straightness of outflow air increases. Hence, even if air is blown along the ceiling, the air does not collide with the ceiling. Therefore, smudging is prevented.

Furthermore, since the length of the deflection guide (corresponding to a length in a direction parallel to the body side board) is suppressed to a predetermined length, a satisfactory area of the body air outlet is provided and the power consumption is reduced. Thus, a high-quality, energy-saving air-conditioning-apparatus indoor unit is provided.

DESCRIPTION OF EMBODIMENTS

[Embodiment 1]

(Air-Conditioning-Apparatus Indoor Unit—Part 1)

Figure 1:
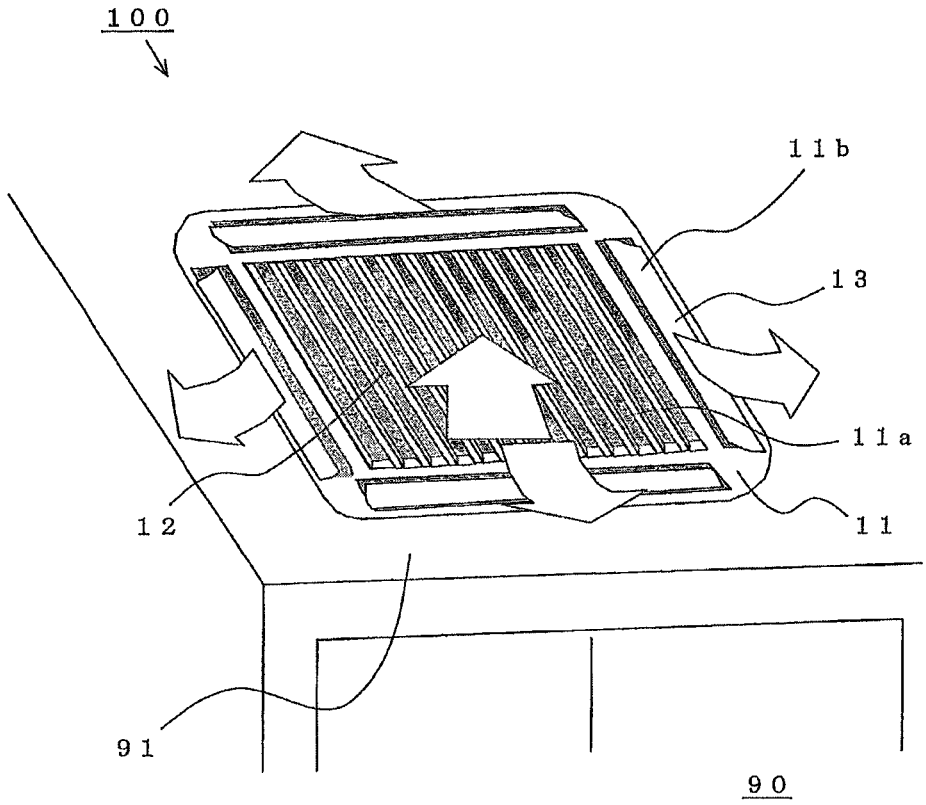
FIG. 1 an outside view illustrating an air-conditioning-apparatus indoor unit according to Embodiment 1 of the present invention.
Figure 2:
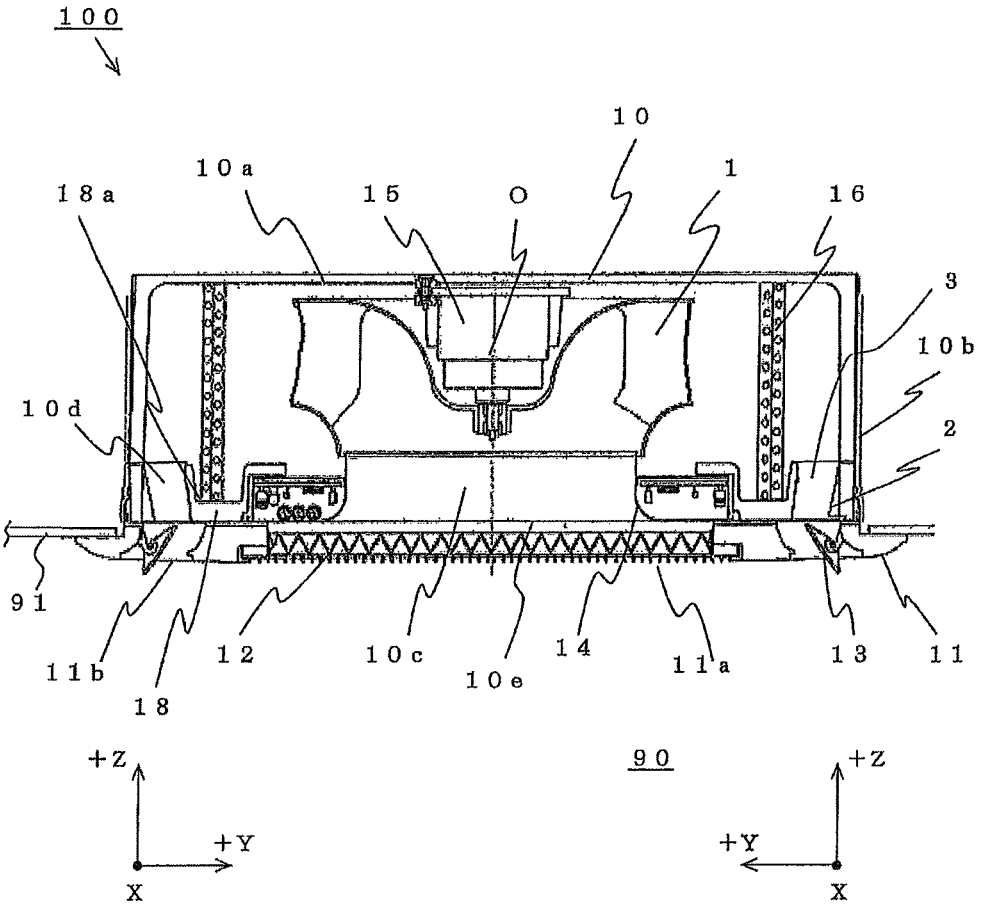
FIG. 2 is a sectional side view illustrating the air-conditioning-apparatus indoor unit illustrated in FIG. 1.
Figure 3:
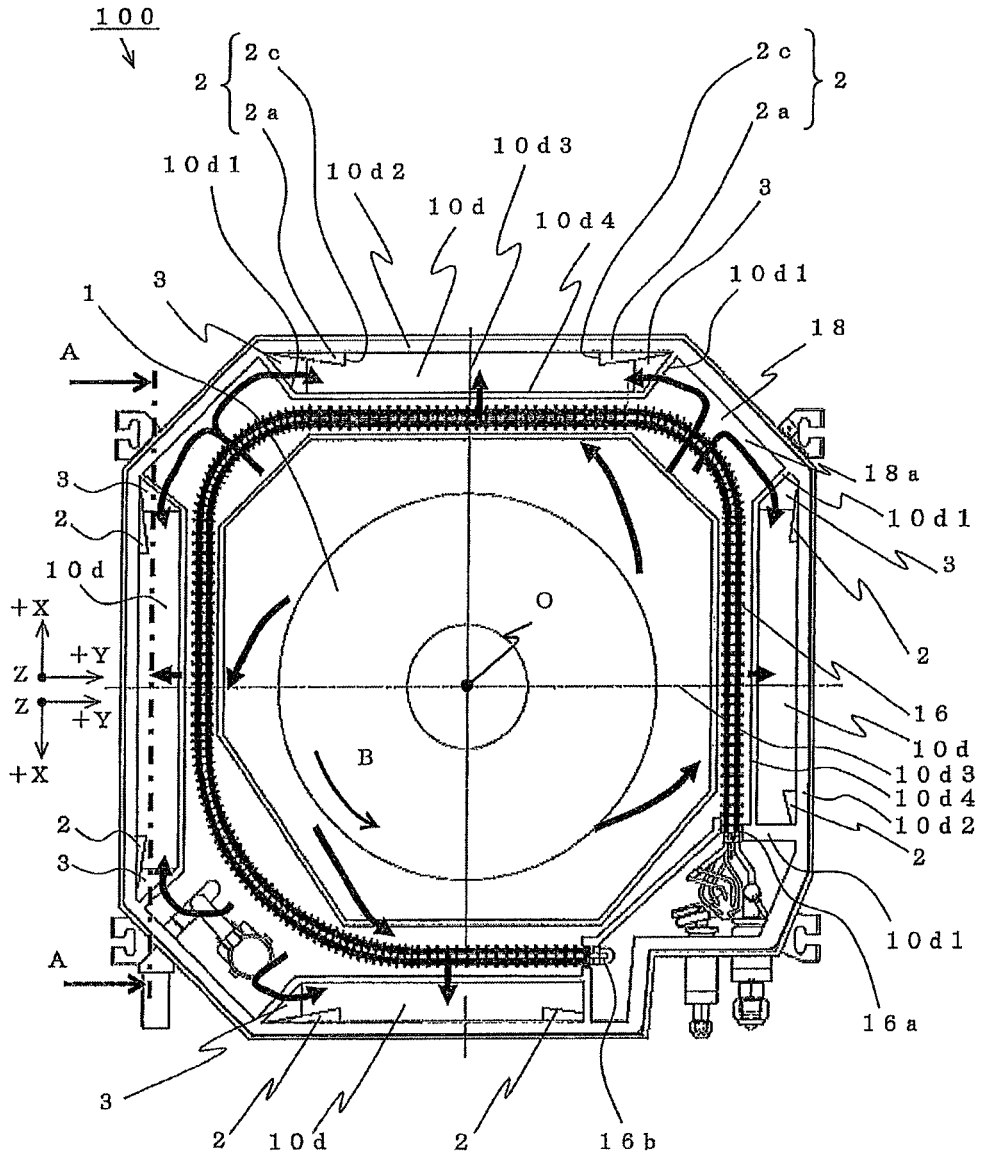
FIG. 3 is a sectional plan view illustrating the air-conditioning-apparatus indoor unit illustrated in FIG. 1.
Figure 4:
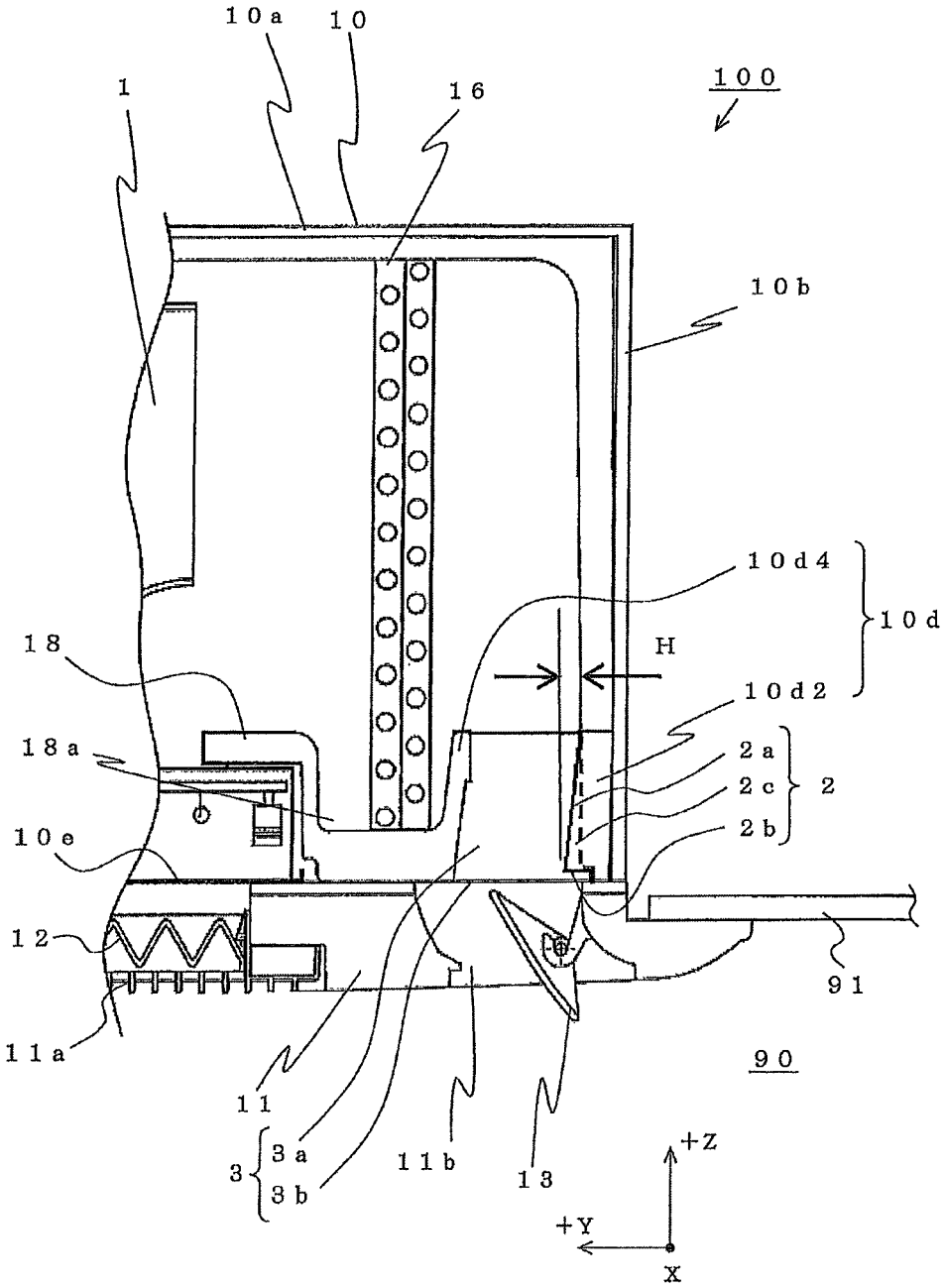
FIG. 4 is an enlarged sectional side view illustrating a part of the air-conditioning-apparatus indoor unit illustrated in FIG. 1.
Figure 5:
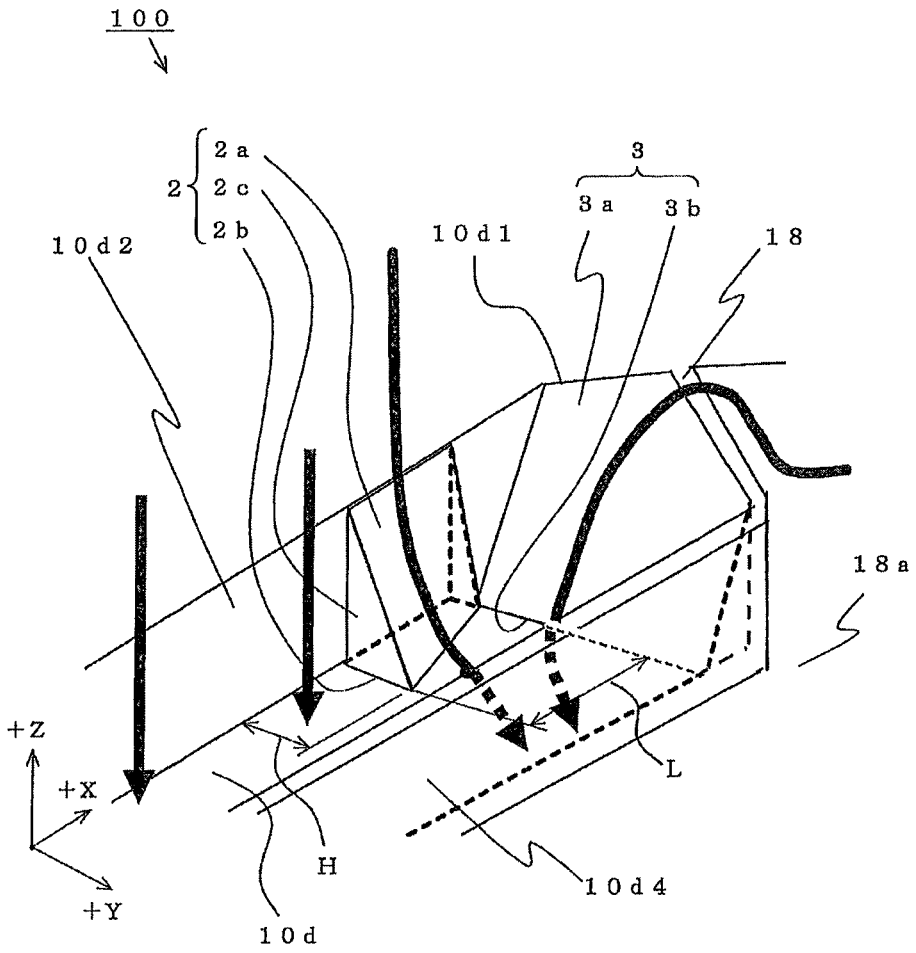
FIG. 5 is an enlarged perspective side view illustrating a part of the air-conditioning-apparatus indoor unit illustrated in FIG. 1.
Figure 6:
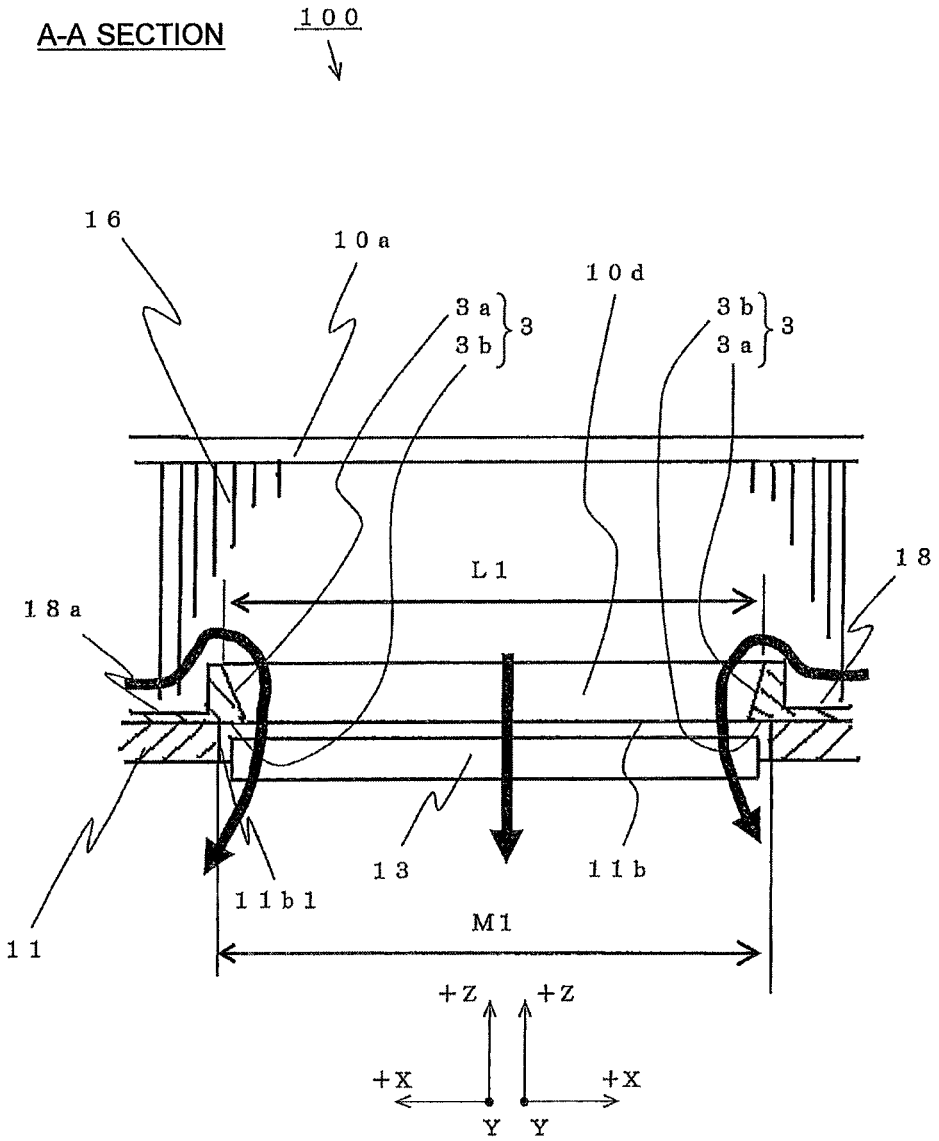
FIG. 6 is a sectional front view illustrating a part of the air-conditioning-apparatus indoor unit illustrated in FIG. 1.

FIGS. 1 to 6 illustrate an air-conditioning-apparatus indoor unit according to Embodiment 1 of the present invention. FIG. 1 is an outside view illustrating a state of installation that is seen from a room. FIG. 2 is a sectional side view taken along a plane containing the central axis. FIG. 3 is a sectional plan view. FIG. 4 is an enlarged sectional side view illustrating a part around a body air outlet. FIG. 5 is an enlarged perspective side view illustrating a part around an end of the body air outlet. FIG. 6 is a sectional front view (taken along line A-A in FIG. 3) illustrating a part around the body air outlet.

In the drawings, the same or like elements are denoted by the same reference numerals. The drawings are only schematic, and the present invention is not limited to the form illustrated therein.

While Embodiment 1 concerns an exemplary ceiling-concealed air-conditioning-apparatus indoor unit, the present invention is not limited thereto. The present invention is widely applicable to any air-conditioning-apparatus indoor units that each include a fan and a heat exchanger and are each capable of cooling and heating of air.

(Indoor Unit Body)

Referring to FIGS. 1 to 6, an indoor unit body 10 of an air-conditioning-apparatus indoor unit 100 is a casing (having a box shape) that includes a body top board 10*a* having a substantially rectangular shape, and a body side board 10*b* connected to all sides of the body top board 10*a*. A face of the indoor unit body 10 that is opposite the body top board 10*a* is open, providing a body open face 10*e*.

The indoor unit body 10 is installed in a recess provided in a ceiling 91 of a room 90 with the body open face 10*e* thereof facing the room (facing downward). The body top board 10*a* extends parallel to the ceiling 91. The body open face 10*e* (corresponding to the lower edge of the body side board 10*b*) is substantially flush with the ceiling 91 (see FIG. 2).

Hereinafter, for the convenience of description, a coordinate system is defined as follows. Assuming that the ceiling 91 extends horizontally, the upward direction is referred to as "+Z direction (or Z axis)," a direction perpendicular to each specific face of the body side board 10*b* and heading toward a central axis O of the indoor unit body 10 is referred to as "+Y direction (or Y axis)," and a direction parallel to the body side board 10*b* and going away from the Y axis is referred to as "+X direction (or X axis)." The body side board 10*b* has a substantially rectangular shape in plan view (the body side board 10*b* includes four linear portions). Accordingly, for each of the sides (linear portions), there are two directions that are parallel to the body side board 10*b* while going away from the Y axis. Hence, two coordinate systems are defined for each of the sides. Some of members and portions that are the same as those provided on different sides are not denoted by reference numerals in the drawings (see FIG. 3).

A decorative panel 11 having a substantially rectangular shape in plan view (in an X-Y plane) is attached to the lower side of the body open face 10*e* of the indoor unit body 10. That is, the decorative panel 11 is substantially flush with the ceiling 91 and faces the room 90.

The decorative panel 11 has an air inlet grille 11*a* provided near the center thereof and serving as an air inlet that allows air to flow into the indoor unit body 10. The decorative panel 11 also has decorative-panel air outlets 11*b* provided along the respective sides of the decorative panel 11 in such a manner as to surround the air inlet grille 11*a*. The decorative panel 11 also has a filter 12 provided above (in the +Z direction, corresponding to the downstream side of inflow air) the air inlet grille 11*a* and that removes dust from air passing through the air inlet grille 11*a*. The decorative-panel air outlets 11*b* are provided with respective air-directing vanes 13 (see FIG. 2).

A turbofan (corresponding to an air-sending fan) 1 is provided inside and at the center of the indoor unit body 10. A fan motor 15 that drives the turbofan 1 to rotate is attached to the body top board 10*a*. The centers of rotation of the turbofan 1 and the fan motor 15 coincide with the central axis O of the indoor unit body 10.

A bellmouth 14 that forms an inflow air passage for air that is taken into the turbofan 1 is provided between the filter 12 and the turbofan 1. An area enclosed by the bellmouth 14 forms a body air inlet 10*c* (see FIG. 2).

(Body Air Outlet)

A heat exchanger 16 having a substantially rectangular shape in plan view and enclosing the turbofan 1 stands from the body top board 10*a* (see FIG. 3) and is connected to an outdoor unit by a non-illustrated connection pipe. A drain pan 18 including a drain reservoir 18*a* that temporarily stores condensed water generated by the heat exchanger 16 is provided below the heat exchanger 16. Four body air outlets 10*d* are provided between the drain pan 18 and the respective linear portions of the body side board 10*b* (see FIGS. 2 and 3).

In this case, the body air inlet 10*c* of the indoor unit body 10 and the air inlet grille 11*a* of the decorative panel 11 substantially coincide with each other in plan view, allowing inflow air to flow therethrough. The body air outlets 10*d* of the indoor unit body 10 and the decorative-panel air outlets 11*b* of the decorative panel 11 substantially coincide with each other in plan view, allowing outflow air to flow therethrough.

The body air outlets 10*d* each have a substantially trapezoidal shape in plan view (in the X-Y plane) and is each defined by the following walls: a body-air-outlet outer side wall 10*d*2 extending parallel to the X axis and residing on the side of the body side board 10*b* (on the −Y-direction side), a body-air-outlet inner side wall 10*d*4 extending parallel to the X axis and residing on the side of the heat exchanger 16 (on the +Y-direction side), and a pair (in +X direction) of body-air-outlet end walls 10*d*1 residing at the respective long-side (X-axis) ends of the body air outlet 10*d*.

(Deflection Guide)

Referring to FIGS. 3 to 5, deflection guides 2 are provided at the respective long-side (X-axis) ends of the body-air-outlet outer side wall 10*d*2 of the body air outlet 10*d* and near the respective body-air-outlet end walls 10*d*1. In the Z direction, the deflection guides 2 are each provided in a predetermined area along the body-air-outlet outer side wall 10*d*2 that is on the upstream side (in the +Z direction) of the air-directing vane 13. The lower the portion of the deflection guide 2 (in the −Z direction, or toward the downstream side of the conditioned air), the wider in the −x direction and the +Y direction the deflection guide 2 becomes, as the deflection guide 2 projects in the −X direction and the +Y direction. Hence, the deflection guide 2 has a deflection-guide end facet 2*c* having a right-angled triangular shape in side view (in a Y-Z plane).

In the X direction, the deflection guide 2 extends in a predetermined area from the body-air-outlet end wall 10*d*1 toward a body-air-outlet central part 10*d*3 (in the −X direction). The body-air-outlet central part 10*d*3 is a central part of the linear portion (hereinafter also referred to as "long-side direction") of the body side board 10*b* of the body air outlet 10*d*. Hence, the deflection guide 2 has a deflection-guide upper surface 2*a* having a rectangular and trapezoidal shape in front view (in an X-Z plane).

In the Y direction, the deflection guide 2 has a triangular shape in plan view (in the X-Y plane). The closer the deflection guide 2 toward body-air-outlet central part 10*d*3 (in the −X direction), the wider in the +Y direction the deflection guide 2 becomes, as the deflection guide 2 projects in the +Y direction. Hence, the deflection guide 2 has a deflection-guide lower surface 2*b* having a right-angled triangular shape in plan view (in the X-Y plane). The deflection guide 2 also has a triangular shape in side view (in the Y-Z plane). The closer the deflection guide 2 toward body-air-outlet central part 10*d*3 (in the −X direction), the wider in the +Y direction the deflection guide 2 becomes, as the deflection guide 2 projects in the +Y direction. Hence, the deflection guide 2 has the deflection-guide end facet 2*c* having a right-angled triangular shape in side view (in the Y-Z plane).

The length from the body-air-outlet outer side wall 10*d*2 to a position of the deflection-guide upper surface 2*a* that is farthest (most projecting) from the body-air-outlet outer side wall 10*d*2 is referred to as "step height H." The deflection-guide upper surface 2*a* and the deflection-guide lower surface 2*b* form an acute angle therebetween.

(Sloping Guide)

Sloping guides 3 are provided at the respective body-air-outlet end walls 10*d*1 of the body air outlet 10*d*. The heat exchanger 16 includes a heat-exchanger refrigerant receiving portion 16*a* and a heat-exchanger refrigerant turn-around portion 16*b* that are provided at the lower right corner in FIG. 3. The drain pan 18 is absent in an area between the heat-exchanger refrigerant receiving portion 16*a* and the heat-exchanger refrigerant turn-around portion 16*b* in plan view. Non-illustrated connecting means that provides connection to the outdoor unit is provided in that area of the indoor unit body 10.

Therefore, in the above area, conditioned air that has been blown from the turbofan 1 is blocked by the connecting means. Consequently, the conditioned air does not flow (precisely speaking, the conditioned air is difficult to flow) toward those body-air-outlet end walls 10*d*1 of the body air outlets 10*d* that are provided at respective positions corresponding to the heat-exchanger refrigerant receiving portion 16*a* and the heat-exchanger refrigerant turn-around portion 16*b*.

Hence, those body-air-outlet end walls 10*d*1 of the body air outlet 10*d* that are provided at the respective positions corresponding to the heat-exchanger refrigerant receiving portion 16*a* and the heat-exchanger refrigerant turn-around portion 16*b* are not provided with the sloping guides 3. In contrast, each of the other body air outlets 10*d* that are provided on the upper side and the left side in FIG. 3 is provided with the sloping guides 3 at the two respective ends thereof, where the conditioned air flows from corresponding ones of the body-air-outlet end walls 10*d*1.

In the Z direction, the sloping guides 3 are each provided in a predetermined area of the body air outlet 10*d*, which resides on the upstream side (in the +Z direction) of the air-directing vane 13. The lower the portion of the sloping guide 3 (in the −Z direction), the wider in the −X direction the sloping guide 3 becomes, as the sloping guide 3 projects in the −X direction. That is, the sloping guide 3 has a sloping-guide upper surface 3*a* that is in contact with the deflection-guide upper surface 2*a* of the deflection guide 2 and with the body-air-outlet end wall 10*d*1 and the body-air-outlet inner side wall 10*d*4 of the body air outlet 10*d*. The lower edge of the sloping-guide upper surface 3*a* is parallel to the Y axis. Hence, the sloping guide 3 has a sloping-guide lower surface (corresponding to a stepped portion) 3*b* having a trapezoidal shape in plan view (in the X-Y plane). The sloping-guide upper surface 3*a* and the sloping-guide lower surface 3*b* form an acute angle therebetween.

Regarding a pair of sloping guides 3 provided at the two respective X-direction ends of the body air outlet 10*d*, letting a distance between points where the upper edges of the deflection-guide upper surfaces 2*a* are in contact with the body-air-outlet inner side wall 10*d*4 be denoted as "body-air-outlet long-side length L1," and a length of the decorative-panel air outlet 11*b* of the decorative panel 11 in the long-side direction (X direction) be denoted as "decorative-panel-air-outlet long-side length M1," the latter is larger than the former (L1<M1) (see FIG. 6).

(Flow of Air)

In the air-conditioning-apparatus indoor unit 100 configured as described above, when the turbofan 1 rotates as indicated by arrow B (see FIG. 3), air in the room 90 flows through the air inlet grille 11*a* of the decorative panel 11 and the filter 12, where dust in the air is removed. The air further flows through the body air inlet 10*c* and the bellmouth 14, is taken into the turbofan 1, and is blown toward the heat exchanger 16.

Then, the air undergoes heat exchange for heating, cooling, or the like or dehumidification (herein generally referred to as "conditioning") in the heat exchanger 16. The air thus conditioned (herein referred to as "conditioned air") is blown from the body air outlets 10*d* and the decorative-panel air outlets 11*b* into the room 90. In this step, the direction of the airflow is controlled by the air-directing vanes 13.

(Function of Deflection Guide)

Referring to FIGS. 3 to 6, the deflection guide 2 is provided near each of the body-air-outlet end walls 10*d*1 of the body air outlets 10*d*. The amount of projection (corresponding to the step height) of the deflection guide 2 from the body-air-outlet outer side wall 10*d*2 increases in a direction from the end toward the center in the long-side direction (X direction) (increases in the −X direction). Therefore, a portion of the air flowing into each body air outlet 10*d* that is directed toward the deflection guide 2 flows along the body-air-outlet outer side wall 10*d*2, is guided along the deflection-guide upper surface 2*a*, is redirected in such a manner as to flow from the body-air-outlet outer side wall 10*d*2 toward the body-air-outlet inner side wall 10*d*4 (in the +Y direction) and from the side of the body-air-outlet central part 10*d*3 toward the side of the body-air-outlet end wall 10*d*1 (in the +X direction).

Consequently, the air flowing in an area near the body-air-outlet inner side wall 10*d*4 of the body air outlet 10*d* is generally accelerated, whereby the distribution of the speed of outflow air becomes uniform over the entirety of that area. Hence, highly humid air in the room 90 is prevented from flowing in, whereby dew formation is prevented.

In the known art, the flow of air in the area near the body-air-outlet inner side wall 10*d*4 does not change (is not deflected). Therefore, dew formation sometimes occurs.

Since the area where the speed of airflow is low is eliminated, the straightness of outflow air increases. Hence, even if air is blown in a direction parallel to the ceiling 91 (in the horizontal direction), the air does not collide with the ceiling 91. Therefore, smudging is prevented.

Moreover, the length of the deflection guide in the long-side direction (X direction) is limited to a predetermined length and does not need to be longer than necessary. Therefore, the draft resistance in the air passage is reduced, and the power consumption is reduced. In the known art, since the airflow in the lateral direction needs to be controlled, the amount of projection from the body-air-outlet outer side wall (corresponding to the step height in the long-side direction) is uniform in the long-side direction (the X direction) of the air outlet. Therefore, the draft resistance in the air passage is increased.

As a result of the above, a high-quality, energy-saving air-conditioning-apparatus indoor unit 100 is provided.

(Function of Sloping Guide)

Referring to FIGS. 3, 5, and 6, the body-air-outlet end wall 10*d*1 has the sloping guide 3 that includes the sloping-guide upper surface 3*a*. The lower the portion of the sloping-guide upper surface 3*a* (in the −Z direction), the more the sloping-guide upper surface 3*a* projects toward the body-air-outlet central part 10*d*3 (in the −X direction). Hence, the sloping guide 3 is connected to the deflection guide 2 provided on the body-air-outlet outer side wall 10*d*2, and the long-side length of the body air outlet 10*d* is gradually reduced toward the lower side (in the −Z direction).

Therefore, the air blown from the heat exchanger 16 flows toward the body air outlet 10*d* as follows. The air flows from the drain reservoir 18*a* of the drain pan 18, goes over the body-air-outlet end wall 10*d*1, flows into the body air outlet 10*d*, is guided by the sloping guide 3, and is blown from the body air outlet 10*d* along the sloping guide 3 without undergoing separation.

Consequently, in the area near the body-air-outlet end wall 10*d*1, the distribution of airflow speed in the short-side direction (Y direction) becomes uniform. In the known art, since the body-air-outlet end wall extends vertically (parallel to the Z axis), the flow of air is separated into different flows. Hence, the airflow speed is reduced at the corner in the short-side direction (Y direction), making the distribution of airflow speed nonuniform.

As a result of the above, the distribution of airflow speed at the body air outlet 10*d* is made uniform, and the flow of air in the area near the body-air-outlet end wall 10*d*1 is stabilized. Accordingly, highly humid air in the room 90 is further prevented from flowing into the body air outlet 10*d*, whereby dew formation and smudging are prevented.

Thus, a higher-quality air-conditioning-apparatus indoor unit 100 is provided.

Furthermore, the decorative-panel-air-outlet long-side length M1 of the decorative-panel air outlet 11*b* is larger than the body-air-outlet long-side length L1 of the body air outlet 10*d* (L1<M1). Therefore, a negative pressure is generated at each of long-side ends 11*b*1 (see FIG. 6) of the decorative-panel air outlet 11*b*. Hence, the conditioned air that has passed the body-air-outlet end wall 10*d*1 is redirected by the negative pressure in such a direction as to spread in the long-side direction of the decorative-panel air outlet 11*b* and toward the short-side (Y direction) end of the air-directing vane 13. Therefore, dew formation on the air-directing vane 13 is prevented. Thus, a high-quality air-conditioning-apparatus indoor unit 100 is provided.

Letting the length of the deflection guide 2 in the long-side direction (X direction) be denoted as "step length L," the step height H and the step height L, which are determined in accordance with the state of conditioned air that flows in, are not necessarily the same for all of the deflection guides 2.

That is, regarding a specific body air outlet 10*d*, the step height H or the step height L of the deflection guide 2 provided on the upstream side in the direction of rotation (in the counterclockwise direction in FIG. 3) of the turbofan 1 may be different from the step height H or the step height L of the deflection guide 2 provided on the downstream side in the direction of rotation (in the clockwise direction in FIG. 3) of the turbofan 1.

Furthermore, the step height H or the step height L of the deflection guide 2 provided near the heat-exchanger refrigerant receiving portion 16*a* may be different from the step height H or the step height L of the deflection guide 2 provided near the heat-exchanger refrigerant receiving portion 16*a*.

Furthermore, the step height H or the step height L of the deflection guide 2 in the body air outlet 10*d* provided near the heat-exchanger refrigerant receiving portion 16*a* may be different from the step height H or the step height L of the deflection guide 2 in the body air outlet 10*d*2 that is provided far from the heat-exchanger refrigerant receiving portion 16*a*.

[Embodiment 2]

(Air-Conditioning-Apparatus Indoor Unit—Part 2)

Figure 7:
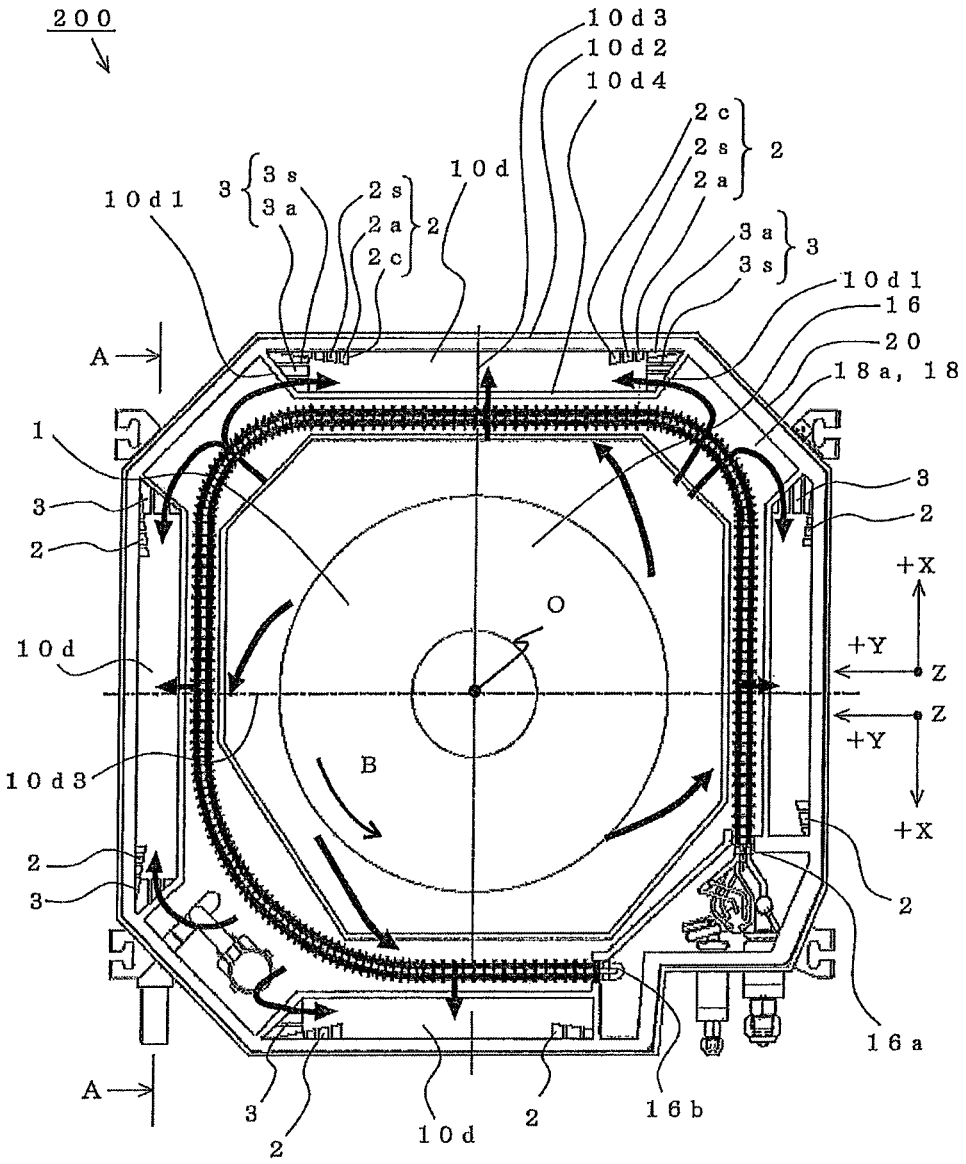
FIG. 7 is a sectional view illustrating an air-conditioning-apparatus indoor unit according to Embodiment 2 of the present invention.
Figure 8:
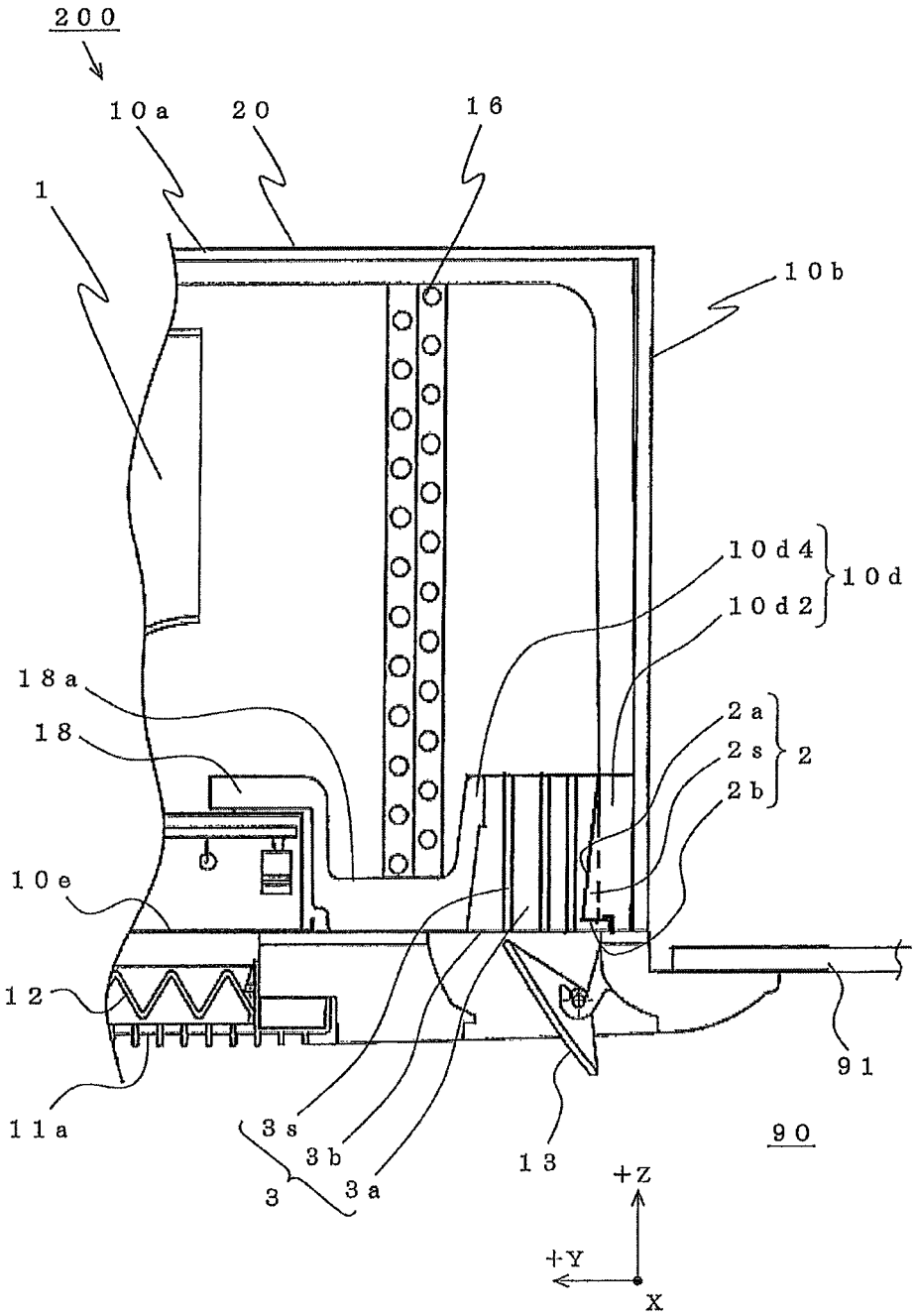
FIG. 8 is an enlarged sectional side view illustrating a part of the air-conditioning-apparatus indoor unit illustrated in FIG. 7.
Figure 9:
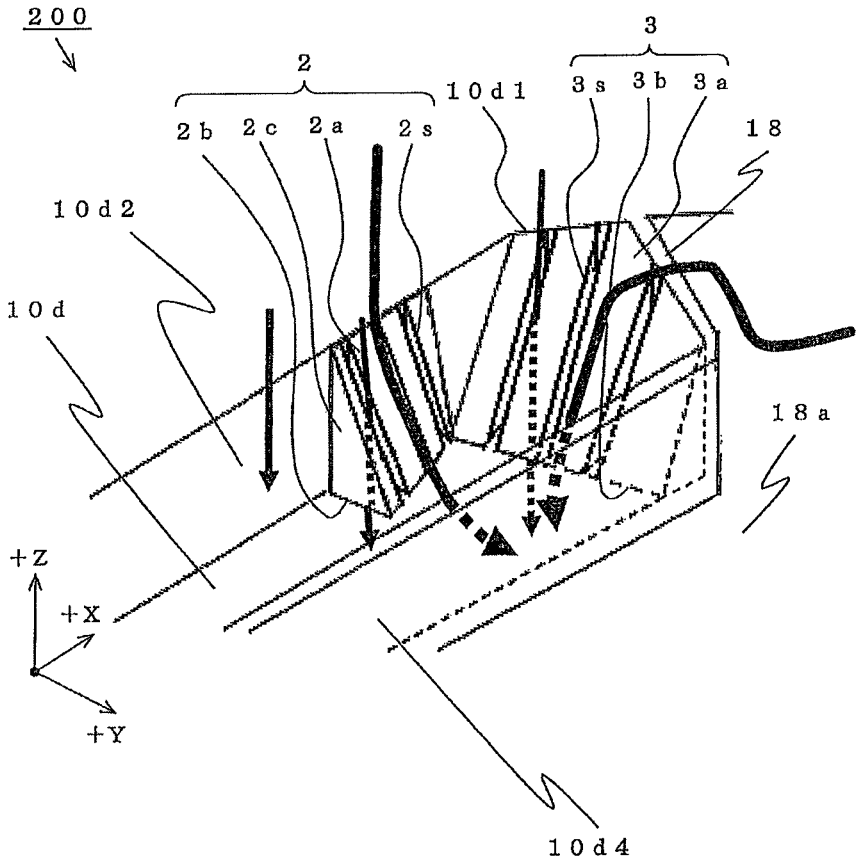
FIG. 9 is an enlarged perspective side view illustrating a part of the air-conditioning-apparatus indoor unit illustrated in FIG. 7.
Figure 10:
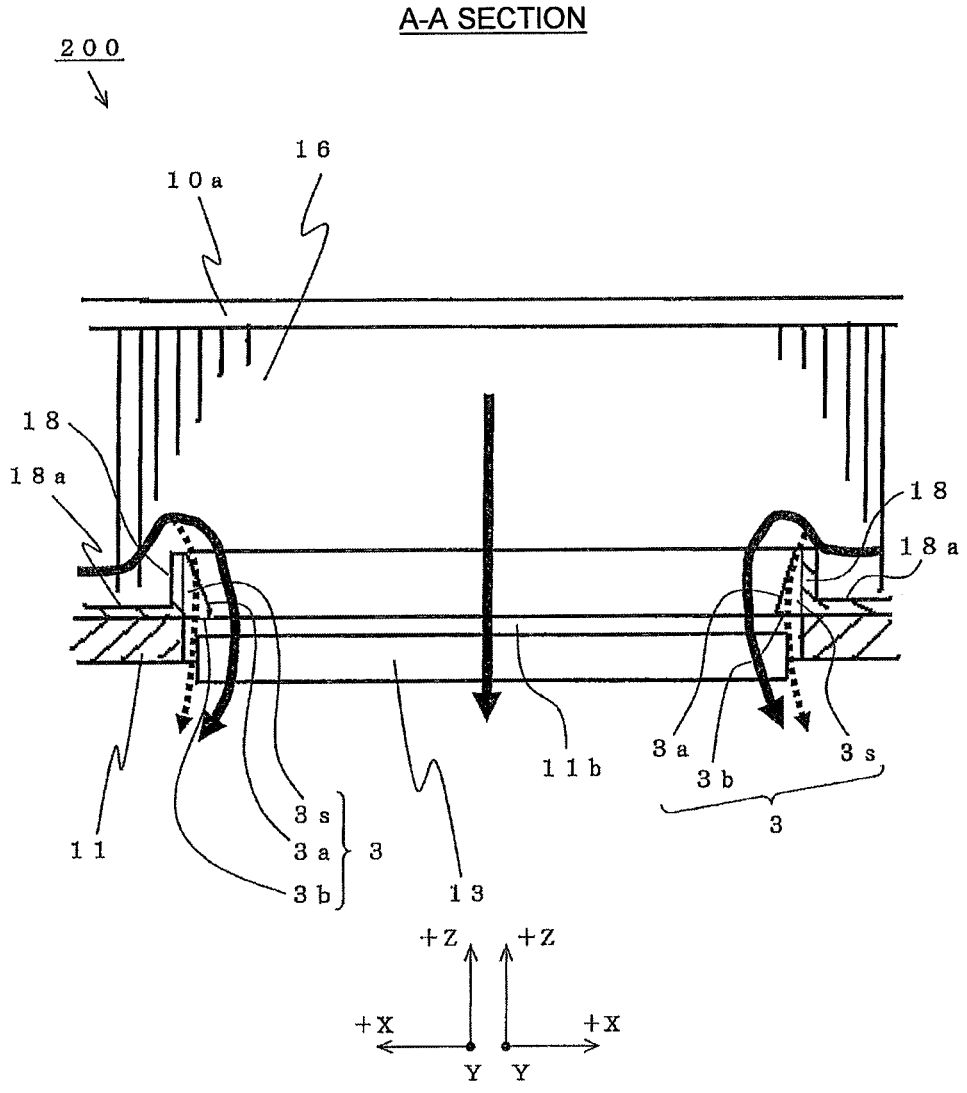
FIG. 10 is a sectional front view illustrating a part of the air-conditioning-apparatus indoor unit illustrated in FIG. 7.

FIGS. 7 to 10 illustrate an air-conditioning-apparatus indoor unit according to Embodiment 2 of the present invention. FIG. 7 is a sectional plan view. FIG. 8 is an enlarged sectional side view illustrating a part around the body air outlet. FIG. 9 is an enlarged perspective side view illustrating a part around an end of the body air outlet. FIG. 10 is a sectional front view (taken along line A-A in FIG. 7) illustrating a part around the body air outlet.

Elements that are the same as or correspond to those described in Embodiment 1 are denoted by corresponding ones of the reference numerals used in Embodiment 1, and description of some of those elements is omitted. The drawings are only schematic, and the present invention is not limited to the form illustrated therein.

Referring to FIGS. 7 to 10, in an indoor unit body 20 of an air-conditioning-apparatus indoor unit 200, the deflection-guide upper surface 2*a* of the deflection guide 2 has deflection-guide slits 2*s*. The deflection-guide slits 2*s* each extend up to the body-air-outlet outer side wall 10*d*2 and the deflection-guide lower surface 2*b*, and are each parallel to the Y-Z plane (that is, perpendicular to both the body-air-outlet outer side wall 10*d*2 and the body open face 10*e*). The deflection-guide slits 2*s* are arranged at predetermined intervals in the long-side direction (the X direction) of the air outlet.

Furthermore, the sloping-guide upper surface 3*a* of the sloping guide 3 has sloping-guide slits 3*s*. The sloping-guide slits 3*s* each extend up to the body-air-outlet end wall 10*d*1 and the sloping-guide lower surface 3*b* and are each parallel to the X-Z plane (that is, parallel to the body-air-outlet outer side wall 10*d*2 and perpendicular to the body open face 10*e*). The sloping-guide slits 3*s* are arranged at predetermined intervals in the short-side direction (the Y direction) of the air outlet.

Hence, most of the conditioned air that has been blown toward the deflection guide 2 and the sloping guide 3 is guided along the deflection-guide upper surface 2*a* and the sloping-guide upper surface 3*a* and is redirected as described in Embodiment 1.

However, since the deflection-guide upper surface 2*a* and the sloping-guide upper surface 3*a* have the deflection guide slits 2*s* and the sloping-guide slits 3*s*, respectively, a portion of the conditioned air that has flowed toward the deflection guide 2 and the sloping guide 3 flows off the deflection-guide upper surface 2*a* and the sloping-guide upper surface 3*a* into the deflection guide slits 2*s* and the sloping-guide slits 3*s*, flows through the deflection guide slits 2*s* and the sloping-guide slits 3*s*, and is blown downward (in the −Z direction).

That is, a portion of the conditioned air is blown from halfway positions of the deflection-guide lower surface 2*b* and the sloping-guide lower surface 3*b* toward the lower side (in the −Z direction). Therefore, even if the air-directing vane 13 is rotated so as to control the direction of the airflow and the direction of the airflow is thus changed, air in the room 90 is prevented from flowing in from positions of the decorative-panel air outlet 11*b* where the deflection-guide lower surface 2*b* and the sloping-guide lower surface 3*b* reside. Hence, dew formation does not occur.

Such a change in the direction of the flow of the conditioned air prevents the occurrence of dew formation. Thus, a high-quality air-conditioning-apparatus indoor unit 200 is provided.

While Embodiments 1 and 2 each concern a case where the deflection guide 2 and the sloping guide 3 are integrated with the drain pan 18, they may be provided as separate components that are secured together.

If the deflection-guide upper surfaces 2*a* of the deflection guides 2 and the sloping-guide upper surfaces 3*a* of the sloping guides 3 provided at different body air outlets are provided at different angles so as to be more suitable for the states of distributions of the airflow speed at the respective body air outlets, further prevention of dew formation and smudging and a reduction in the draft resistance are realized.

[Embodiment 3]

(Air-Conditioning-Apparatus Indoor Unit—Part 3)

Figure 11:
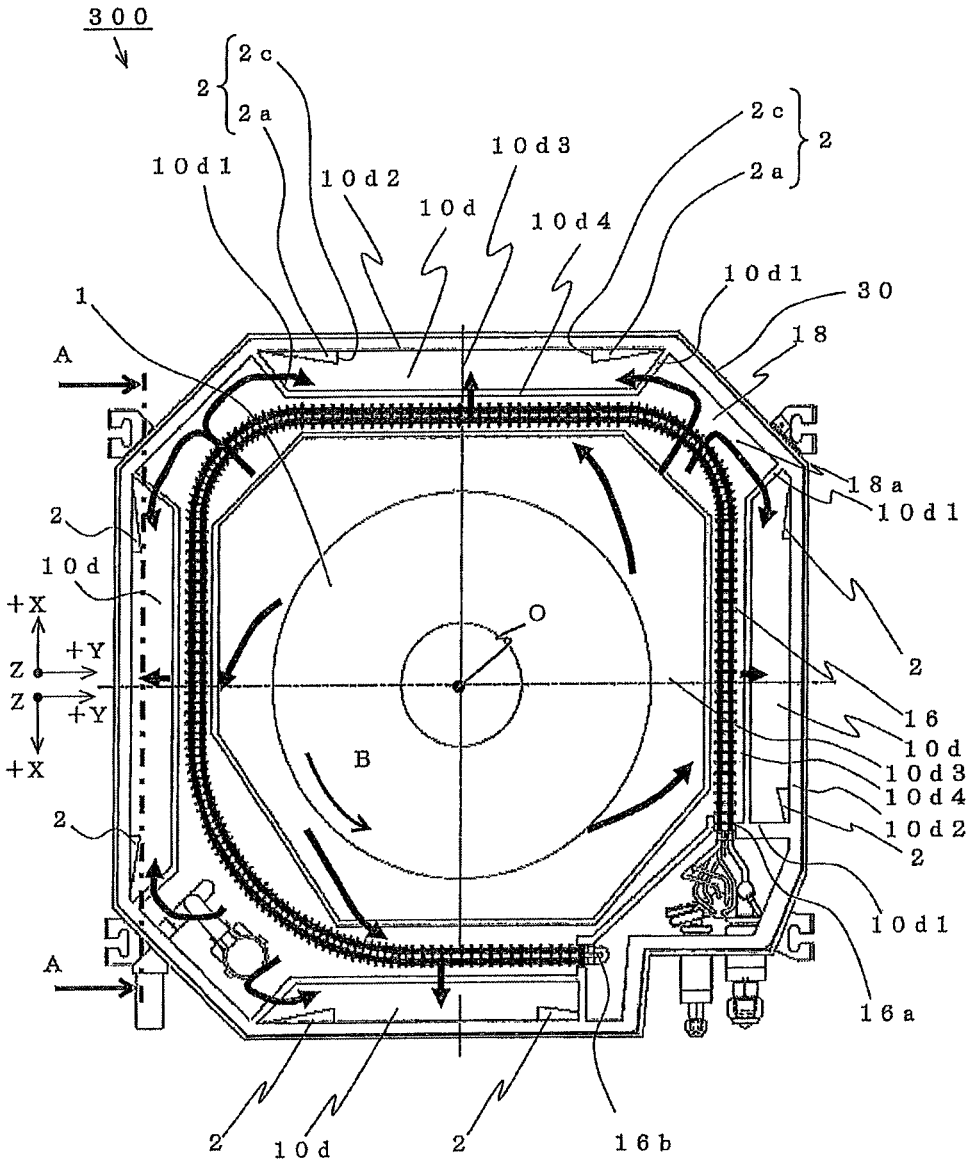
FIG. 11 is a sectional view illustrating an air-conditioning-apparatus indoor unit according to Embodiment 3 of the present invention.
Figure 12:
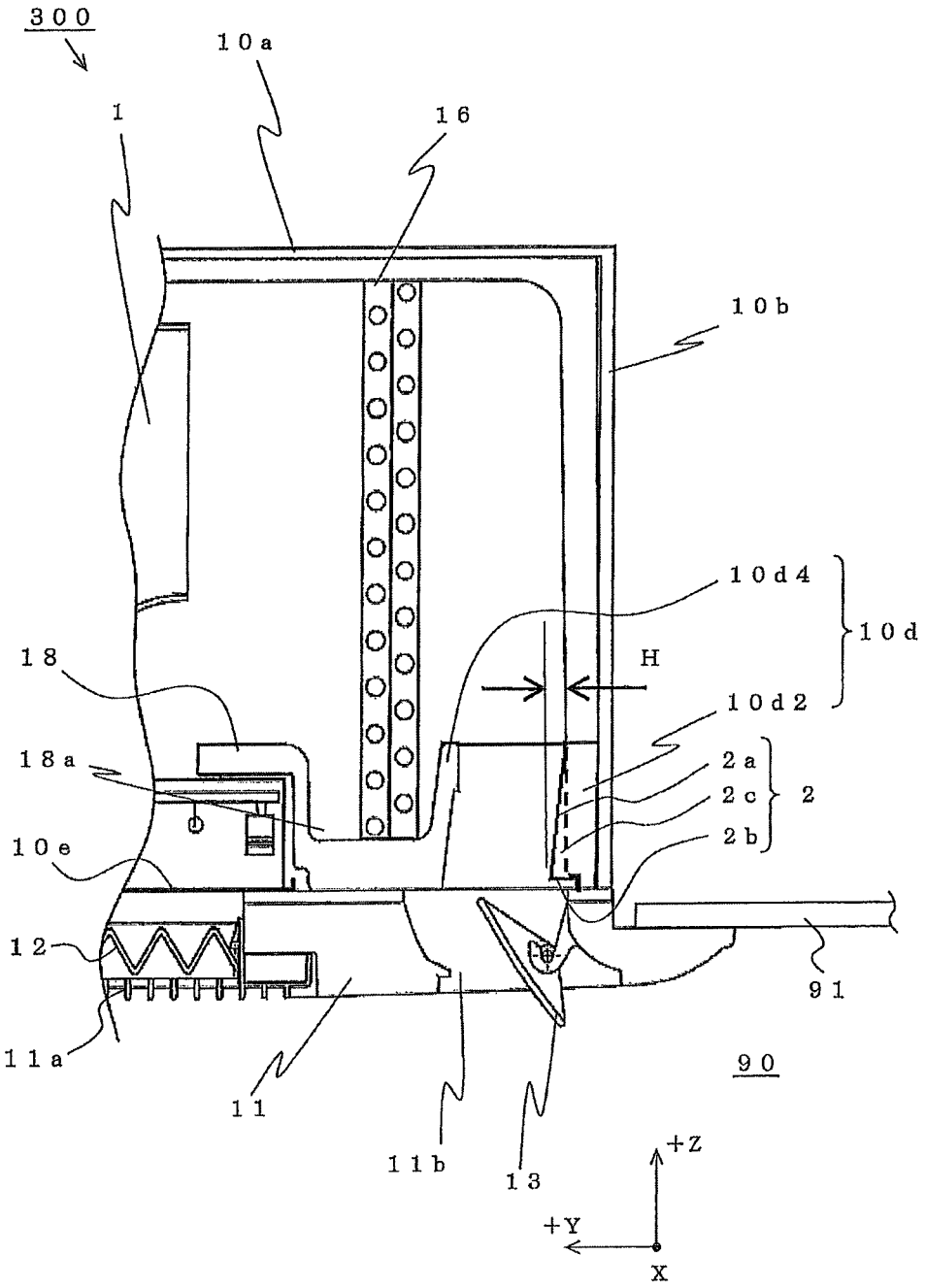
FIG. 12 is an enlarged sectional view illustrating a part of the air-conditioning-apparatus indoor unit illustrated in FIG. 11.
Figure 13:
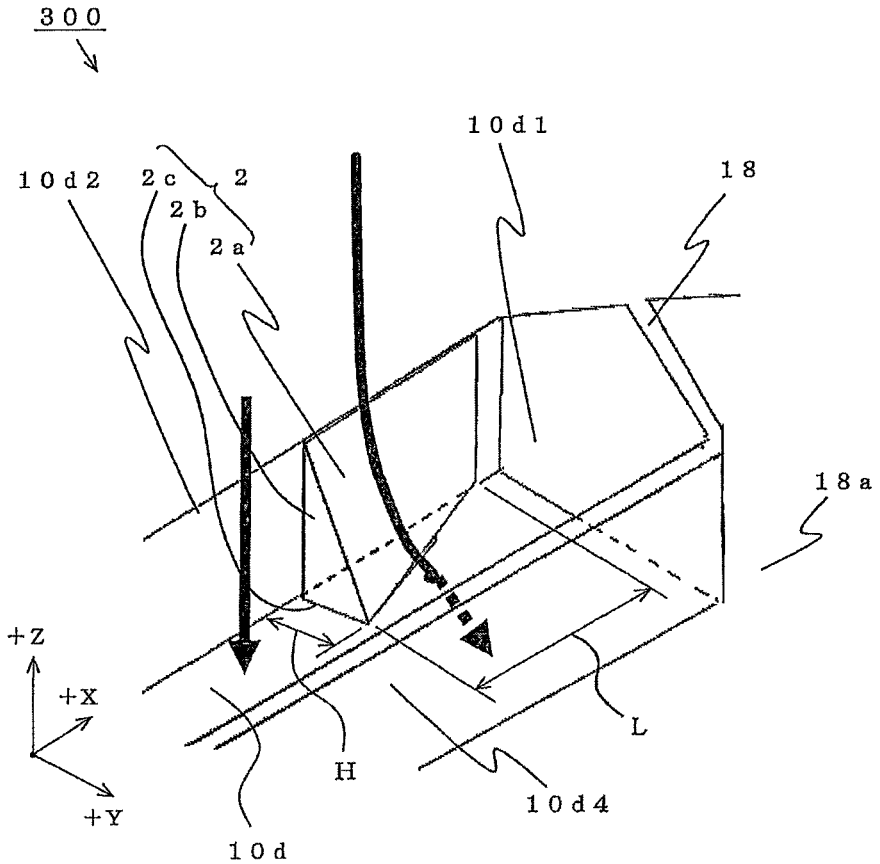
FIG. 13 is an enlarged perspective view illustrating a part of the air-conditioning-apparatus indoor unit illustrated in FIG. 11.

FIGS. 11 to 13 illustrate an air-conditioning-apparatus indoor unit according to Embodiment 3 of the present invention. FIG. 11 is a sectional plan view. FIG. 12 is an enlarged sectional side view illustrating a part around the body air outlet. FIG. 13 is an enlarged perspective side view illustrating a part around an end of the body air outlet. Elements that are the same as or correspond to those described in Embodiment 1 are denoted by corresponding ones of the reference numerals used in Embodiment 1, and description of some of those elements is omitted. In the drawings, the same or like elements are denoted by the same reference numerals. The drawings are only schematic, and the present invention is not limited to the form illustrated therein.

Referring to FIGS. 11 to 13, an indoor unit body 30 of an air-conditioning-apparatus indoor unit 300 is the same as the indoor unit body 10 of the indoor unit 100 described in Embodiment 1 except that the sloping guides 3 are removed and only the deflection guides 2 are provided at the body air outlets 10*d*.

Hence, as with the indoor unit 100, regarding the air flowing into each body air outlet 10*d*, a portion that is flowing toward the deflection guide 2 flows near the body-air-outlet outer side wall 10*d*2, is guided along the deflection-guide upper surface 2*a*, is redirected in such a manner as to flow in a direction from the body outer body side wall 10*d*2 toward the body-air-outlet inner side wall 10*d*4 (in the +Y direction) and also in a direction from the body-air-outlet central part 10*d*3 toward the body-air-outlet end wall 10*d*1 (in the +X direction) (see FIG. 13).

Consequently, as with the indoor unit 100, the air flowing in a whole area near the body-air-outlet inner side wall 10*d*4 of the body air outlet 10*d* is accelerated, whereby the distribution of the speed of outflow air becomes uniform over the entirety of that area. Hence, highly humid air in the room 90 is prevented from flowing in, whereby dew formation is prevented. Moreover, since the area where the speed of airflow is low is eliminated, the straightness of outflow air increases. Hence, even if air is blown in a direction parallel to the ceiling 91 (in the horizontal direction), the air does not collide with the ceiling 91. Therefore, smudging is prevented. Furthermore, the length of the deflection guide in the long-side direction (X direction) is limited to a predetermined length (denoted by "L" in FIG. 13) and does not need to be longer than necessary. Therefore, the draft resistance in the air passage is reduced, and the power consumption is reduced.

As a result of the above, a high-quality, energy-saving air-conditioning-apparatus indoor unit 300 is provided.

[Embodiment 4]

(Air-Conditioning-Apparatus Indoor Unit—Part 4)

Figure 14:
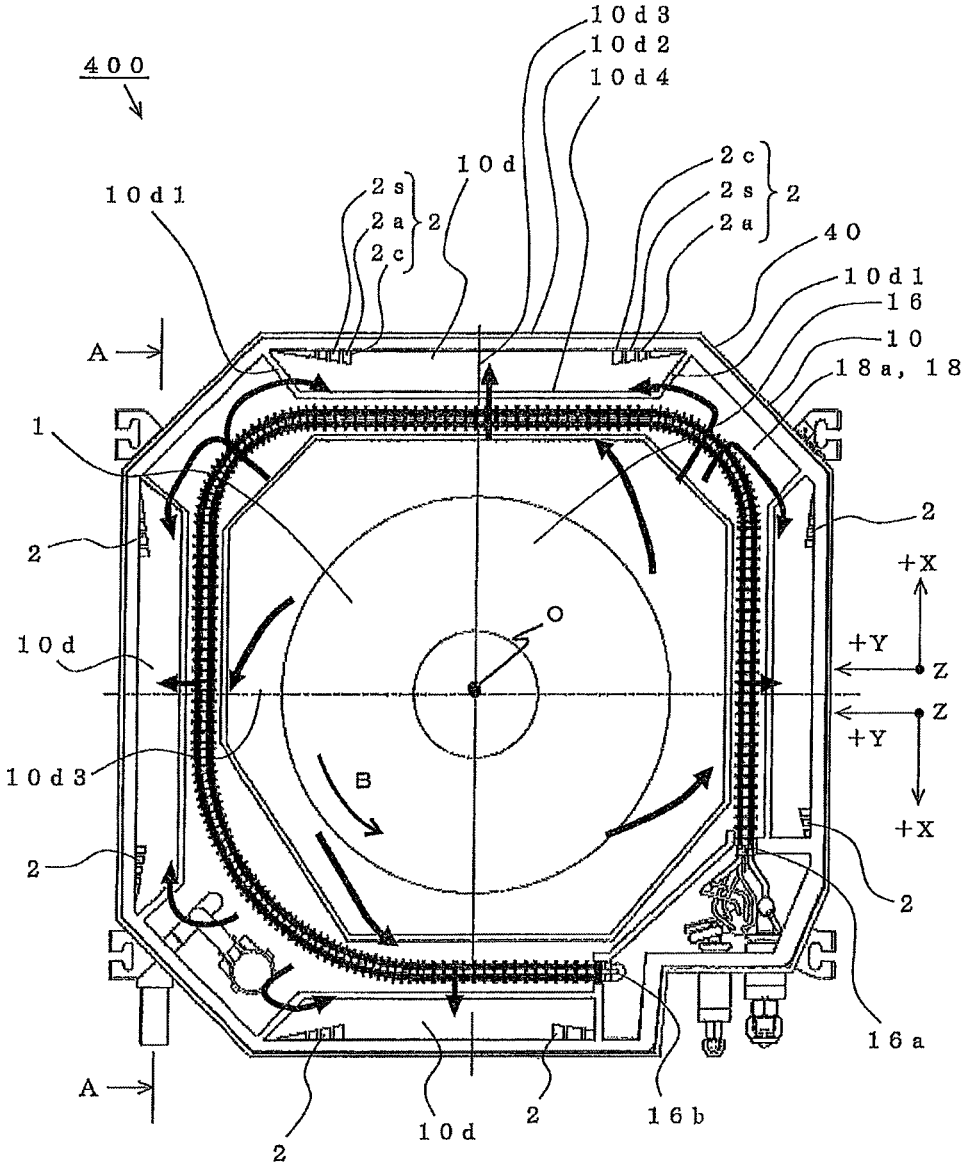
FIG. 14 is a sectional view illustrating an air-conditioning-apparatus indoor unit according to Embodiment 4 of the present invention.
Figure 15:
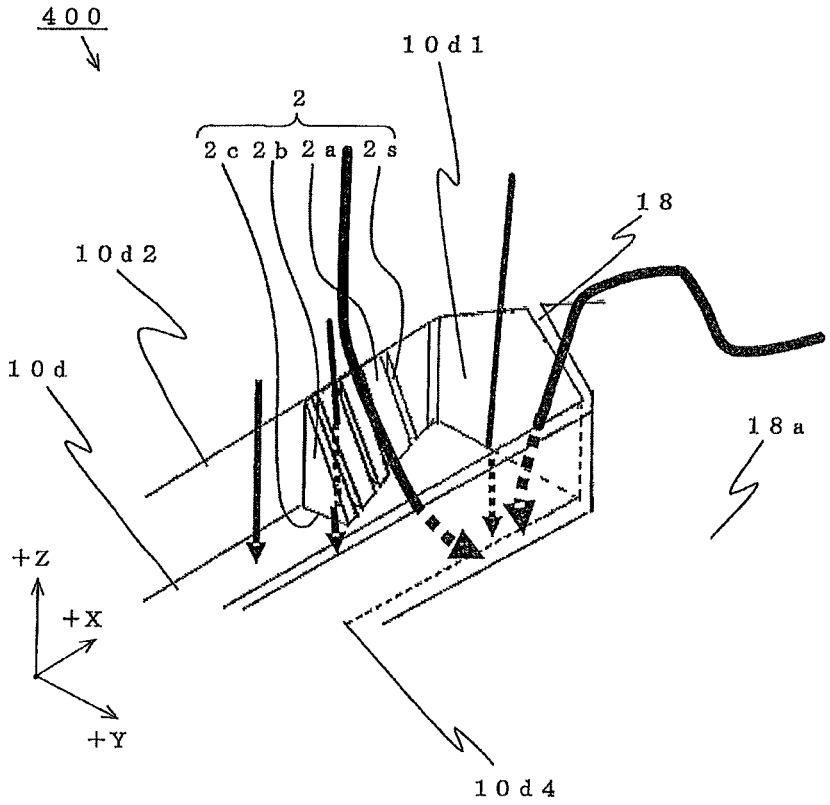
FIG. 15 is an enlarged perspective view illustrating a part of the air-conditioning-apparatus indoor unit illustrated in FIG. 14.

FIGS. 14 and 15 illustrate an air-conditioning-apparatus indoor unit according to Embodiment 4 of the present invention. FIG. 14 is a sectional plan view. FIG. 15 is an enlarged perspective side view illustrating a part around an end of the body air outlet. Elements that are the same as or correspond to those described in Embodiment 2 are denoted by corresponding ones of the reference numerals used in Embodiment 2, and description of some of those elements is omitted. In the drawings, the same or like elements are denoted by the same reference numerals. The drawings are only schematic, and the present invention is not limited to the form illustrated therein.

Referring to FIGS. 14 and 15, an indoor unit body 40 of an air-conditioning-apparatus indoor unit 400 is the same as the indoor unit body 20 of the indoor unit 200 described in Embodiment 2 except that the sloping guides 3 are removed and only the deflection guides 2 are provided at the body air outlets 10*d*. The indoor unit body 40 is also the same as the indoor unit body 30 of the indoor unit 300 described in Embodiment 3 except that deflection guide slits 2*s* are provided in the deflection guides 2.

Hence, most of the conditioned air that has been blown toward the deflection guide 2 is guided along the deflection-guide upper surface 2*a* and is redirected as described in Embodiment 1. Furthermore, since the deflection guide slits 2*s* are provided on the deflection-guide upper surface 2*a*, a portion of the conditioned air that has flowed toward the deflection guide 2 flows off the deflection-guide upper surface 2*a* into the deflection guide slits 2*s*, flows through the deflection guide slits 2*s*, and is blown downward (in the −Z direction).

That is, a portion of the conditioned air is blown from halfway positions of the deflection-guide lower surface 2*b* toward the lower side (in the −Z direction). Therefore, even if the air-directing vane 13 is rotated so as to control the direction of the airflow and the direction of the airflow is thus changed, air in the room 90 is prevented from flowing in from positions of the decorative-panel air outlet 11*b* where the deflection-guide lower surface 2*b* and the sloping-guide lower surface 3*b* reside. Hence, dew formation does not occur.

Such a change in the direction of the flow of the conditioned air prevents the occurrence of dew formation. Thus, a high-quality air-conditioning-apparatus indoor unit 400 is provided.

[Embodiment 5]

(Air-Conditioning-Apparatus Indoor Unit—Part 5)

Figure 16:
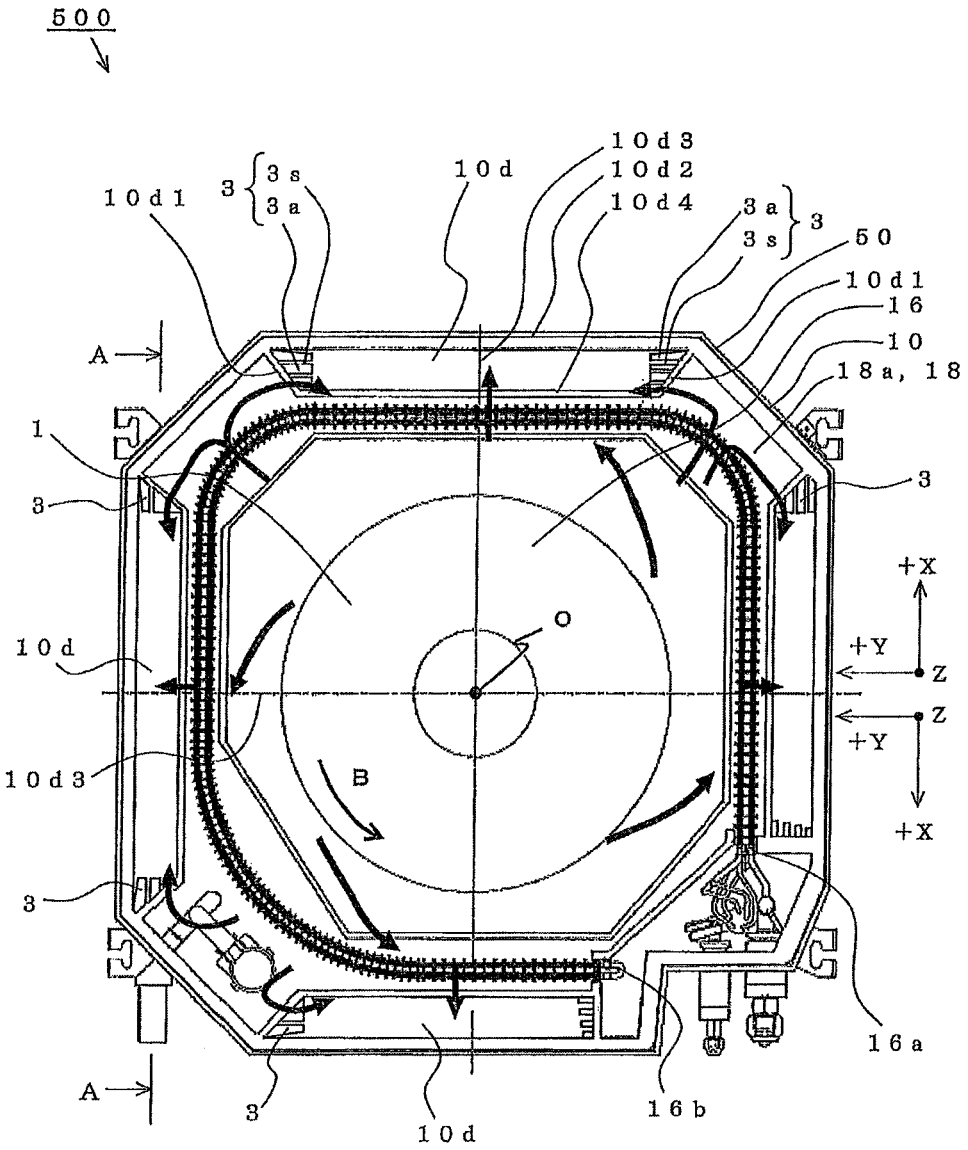
FIG. 16 is a sectional view illustrating an air-conditioning-apparatus indoor unit according to Embodiment 5 of the present invention.
Figure 17:
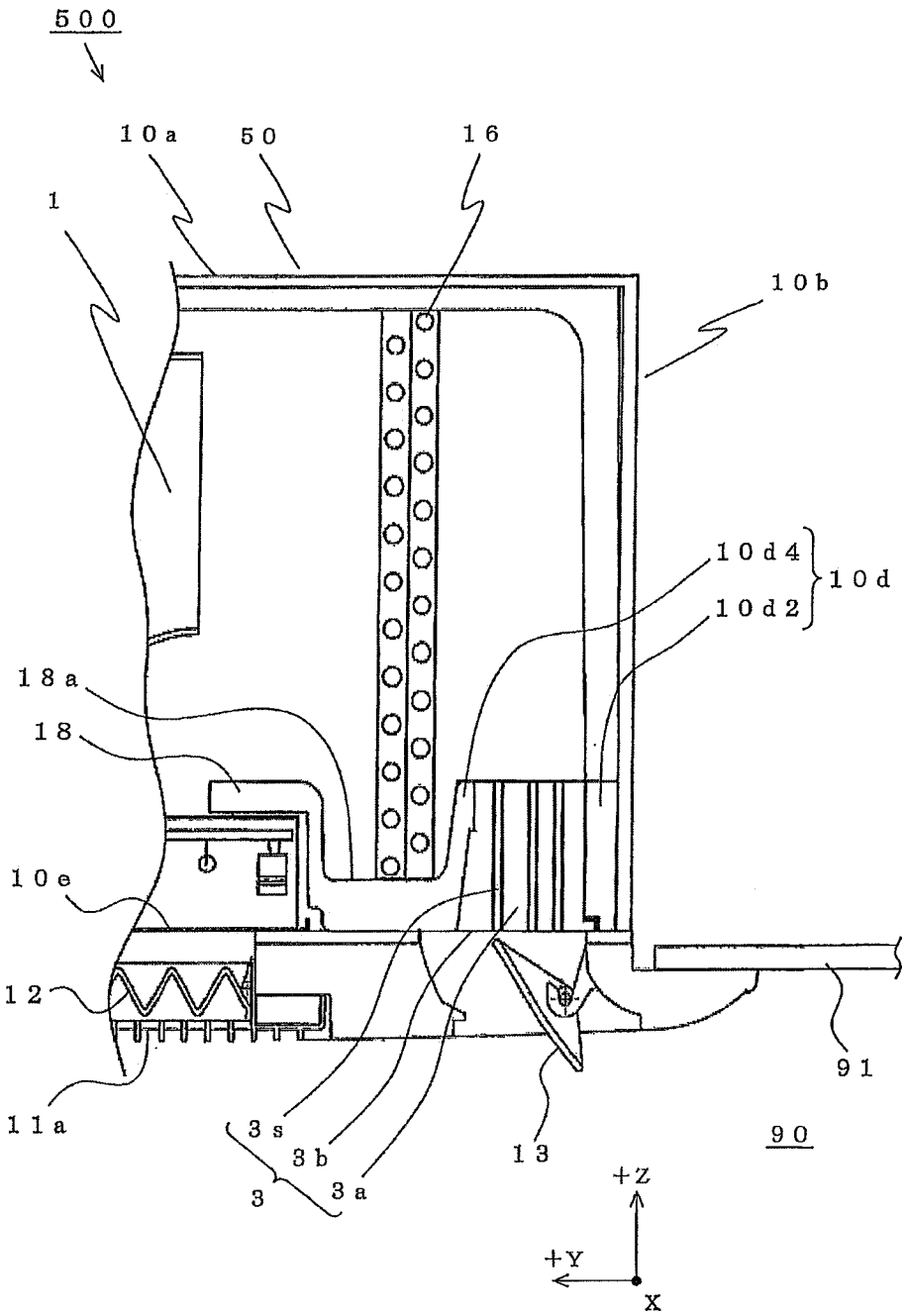
FIG. 17 is an enlarged sectional view illustrating a part of the air-conditioning-apparatus indoor unit illustrated in FIG. 16.
Figure 18:
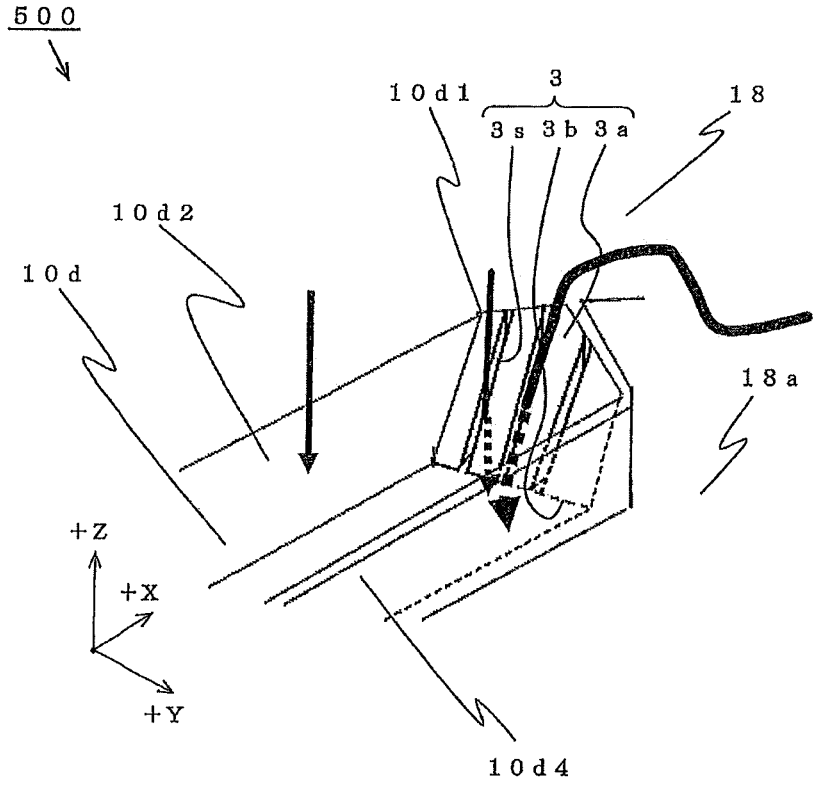
FIG. 18 is an enlarged perspective view illustrating a part of the air-conditioning-apparatus indoor unit illustrated in FIG. 16.

FIGS. 16 to 18 illustrate an air-conditioning-apparatus indoor unit according to Embodiment 5 of the present invention. FIG. 16 is a sectional plan view. FIG. 17 is an enlarged sectional side view illustrating a part around the body air outlet. FIG. 18 is an enlarged perspective side view illustrating a part around an end of the body air outlet. Elements that are the same as or correspond to those described in Embodiment 2 are denoted by corresponding ones of the reference numerals used in Embodiment 2, and description of some of those elements is omitted. In the drawings, the same or like elements are denoted by the same reference numerals. The drawings are only schematic, and the present invention is not limited to the form illustrated therein.

Referring to FIGS. 16 to 18, an indoor unit body 50 of an air-conditioning-apparatus indoor unit 500 is the same as the indoor unit body 20 of the indoor unit 200 described in Embodiment 2 except that the deflection guides 2 are removed and only the sloping guides 3 are provided at the body air outlets 10*d*.

Hence, as with the indoor unit 200, the air that has been blown from the heat exchanger 16 flows toward each of the body air outlets 10*d* as follows. The air flows from the drain reservoir 18*a* of the drain pan 18, goes over the body-air-outlet end wall 10*d*1, flows into the body air outlet 10*d*, is guided by the sloping guide 3, and is blown from the body air outlet 10*d* along the sloping guide 3 without undergoing separation.

Consequently, in the area near the body-air-outlet end wall 10*d*1, the distribution of airflow speed in the short-side direction (Y direction) becomes uniform. In the known art, since the body-air-outlet end wall extends vertically (parallel to the Z axis), the flow of air is separated into different flows. Hence, the airflow speed is reduced at the corner in the short-side direction (Y direction), making the distribution of airflow speed nonuniform. As a result of the above, the distribution of airflow speed at the body air outlet 10*d* is made uniform, and the flow of air in the area near the body-air-outlet end wall 10*d*1 is stabilized. Accordingly, highly humid air in the room 90 is further prevented from flowing into the body air outlet 10*d*, whereby dew formation and smudging are prevented.

Furthermore, since the sloping-guide slits 3*s* are provided in the sloping-guide upper surface 3*a*, a portion of the conditioned air that has flowed toward the sloping guide 3 flows off the sloping-guide upper surface 3*a* into the sloping-guide slits 3*s*, flows through the sloping-guide slits 3*s*, and is blown downward (in the −Z direction).

That is, a portion of the conditioned air is blown from halfway positions of the sloping-guide lower surface 3*b* toward the lower side (in the −Z direction). Therefore, even if the air-directing vane 13 is rotated so as to control the direction of the airflow and the direction of the airflow is thus changed, air in the room 90 is prevented from flowing in from a position of the decorative-panel air outlet 11*b* where the sloping-guide lower surface 3*b* resides. Hence, dew formation does not occur.

Thus, a higher-quality air-conditioning-apparatus indoor unit 500 is provided.

INDUSTRIAL APPLICABILITY

The present invention is not limited to a ceiling-concealed air-conditioning-apparatus indoor unit and is widely applicable to air-conditioning-apparatus indoor units of various types that include similar body air outlets.

REFERENCE SIGNS LIST

1: turbofan, 2: deflection guide, 2*a*: deflection-guide upper surface, 2*b*: deflection-guide lower surface, 2*c*: deflection-guide end facet, 2*s*: deflection guide slit, 3: sloping guide, 3*a*: sloping-guide upper surface, 3*b*: sloping-guide lower surface, 3*s*: sloping-guide slit, 10: indoor unit body (Embodiment 1), 10*a*: body top board, 10*b*: body side board, 10*c*: body air inlet, 10*d*: body air outlet, 10*d*1: body-air-outlet end wall, 10*d*2: body-air-outlet outer side wall, 10*d*3: body-air-outlet long-side central part (body-air-outlet central part), 10*d*4: body-air-outlet inner side wall, 10*e*: body open face, 11: decorative panel, 11*a*: air inlet grille, 11*b*: decorative-panel air outlet, 11*b*1: long-side end of decorative-panel air outlet, 12: filter, 13: air-directing vane, 14: bellmouth, 15: fan motor, 16: heat exchanger, 16*a*: heat-exchanger refrigerant receiving portion, 16*b*: heat-exchanger refrigerant turn-around portion, 18: drain pan, 18*a*: drain reservoir, 20: indoor unit body (Embodiment 2), 30: indoor unit body (Embodiment 3), 40: indoor unit body (Embodiment 4), 50: indoor unit body (Embodiment 5), 90: room, 91: ceiling, 100: air-conditioning-apparatus indoor unit (Embodiment 1), 200: air-conditioning-apparatus indoor unit (Embodiment 2), 300: air-conditioning-apparatus indoor unit (Embodiment 3), 400: air-conditioning-apparatus indoor unit (Embodiment 4), 500: air-conditioning-apparatus indoor unit (Embodiment 5), H: step height of deflection-guide upper surface, L: long-side (X-direction) length of deflection guide, L1: body-air-outlet long-side length, M1: decorative-panel-air-outlet long-side length, O: central axis

The invention claimed is:

1. An air-conditioning-apparatus indoor unit comprising:

a box-shaped body including a body open face;

an air-sending fan provided inside the body; and a heat exchanger provided inside the body in such a manner as to surround the air-sending fan, wherein the body further includes a plurality of body air outlets provided on a periphery of the body open face and configured to blow out air to an outside of the body, the air having been taken in from the body open face and having flowed through the heat exchanger, wherein the plurality of body air outlets are each formed by a body-air-outlet outer side wall provided along a body side board of the body;

a body-air-outlet inner side wall provided by opposing the body-air-outlet outer side wall, and body-air-outlet end walls connecting the body-air-outlet outer side wall and the body-air-outlet inner side wall, and further comprising deflection guides, the body-air-outlet outer side wall is provided with the deflection guides disposed at ends of the body-air-outlet outer side wall, the body-air-outlet outer side wall has an area in which none of the deflection guides exist, said area is on the body-air-outlet outer side wall at a center of the body-air outlet outer side wall in a direction parallel to the body side board, said area is between the defelection guides on the body-air outlet outer side wall, and each of the deflection guides extends in a predetermined area from a respective body-air-outlet end wall toward a central part of the body air outlet, and has a deflection-guide upper surface, the deflection-guide upper surface extends and slants closer to the body-air-outlet inner side wall in a direction from the body-air-outlet outer side wall on sides of the body-air-outlet end walls toward the central part of the body air outlet and extends in a direction from an upper side of the body-air-outlet outer side wall toward a lower side of the body-air-outlet outer side wall.

2. The air-conditioning-apparatus indoor unit of claim 1, wherein at least one of the body-air-outlet end walls is provided with a sloping guide, wherein the sloping guide includes a sloping-guide upper surface projecting toward the central part of the body air outlet as the sloping-guide upper surface extends closer to the body open face, the sloping-guide upper surface being continuous with the deflection-guide upper surface and the body-air-outlet inner side wall.

3. The air-conditioning-apparatus indoor unit of claim 2, further comprising:

a decorative panel that covers the body open face, wherein the decorative panel has decorative-panel air outlets at positions corresponding to the respective body air outlets, and wherein a decorative-panel-air-outlet long-side length (M1), which is a length of each of the decorative-panel air outlets in the direction parallel to the body side board, is larger than a body-air-outlet long-side length (L1), which is a distance between a pair of the body-air-outlet end walls that are opposite each other (M1>L1).

4. The air-conditioning-apparatus indoor unit of claim 1, wherein the deflection guides each have deflection guide slits provided at predetermined intervals and extending perpendicularly to both the body-air-outlet outer side wall and the body open face.

5. The air-conditioning-apparatus indoor unit of claim 2, wherein the sloping guide has sloping guide slits provided at predetermined intervals and extending parallel to the body-air-outlet outer side wall and perpendicularly to the body open face.

6. The air-conditioning-apparatus indoor unit of claim 2, wherein the heat exchanger includes a heat-exchanger refrigerant receiving portion and a heat-exchanger refrigerant turn-around portion, wherein a drain pan is absent at a position on a side of the body open face between the heat-exchanger refrigerant receiving portion and the heat-exchanger refrigerant turn-around portion, and wherein, among the body-air-outlet end walls, the body-air-outlet end walls that reside at positions corresponding to the heat-exchanger refrigerant receiving portion and the heat-exchanger refrigerant turn-around portion, respectively, are free of the sloping guides.

7. The air-conditioning-apparatus indoor unit of claim 1, further comprising a drain pan provided inside the body and below the heat exchanger, wherein the body air outlets are separately provided from one another between the drain pan and the body side board of the body.

8. The air-conditioning-apparatus indoor unit of claim 1, wherein the deflection guides are provided each of the body air outlets, and wherein a step height and a step length of each of the deflection guides are determined in accordance with a state of conditioned air that flows in the body air outlet at which the deflection guides are provided.

9. The air-conditioning-apparatus indoor unit of claim 1, further comprising:

a drain pan provided inside the body and below the heat exchanger, wherein the deflection guides are provided as an integrated component with the drain pan or as separate components from the drain pan.

10. An air-conditioning-apparatus indoor unit comprising:

a box-shaped body including a body open face;

an air-sending fan provided inside the body; and a heat exchanger provided inside the body in such a manner as to surround the air-sending fan, wherein the body further includes a plurality of body air outlets provided on a periphery of the body open face and configured to blow out air to an outside of the body, the air having been taken in from the body open face and having flowed through the heat exchanger, wherein the plurality of body air outlets are each formed by a body-air-outlet outer side wall provided along a body side board of the body;

a body-air-outlet inner side wall provided by opposing the body-air-outlet outer side wall, and body-air-outlet end walls connecting the body-air-outlet outer side wall and the body-air-outlet inner side wall, and further comprising a sloping guide having a sloping-guide upper surface projecting toward a central part of the body air outlet as the sloping guide extends closer to the body open face, the sloping guide is provided on at least one of the body-air-outlet end walls, the sloping-guide upper surface being continuous with the body-air-outlet inner side; and further comprising deflection guides, the body-air-outlet outer side wall is provided with the deflection guides disposed at ends of the body-air-outlet outer side wall, the body-air-outlet outer side wall has an area in which none of the deflection guides exist, said area is on the body-air-outlet outer side wall at a center of the body-air-outlet outer side wall in a direction parallel to the body side board, said area is between the deflection guides on the body-air-outlet side wall wall.

11. The air-conditioning-apparatus indoor unit of claim 10, wherein the sloping guide has sloping guide slits provided at predetermined intervals and extending parallel to the body-air-outlet outer side wall and perpendicularly to the body open face.

12. The air-conditioning-apparatus indoor unit of claim 10, further comprising:

a drain pan provided inside the body and below the heat exchanger, wherein the sloping guide is provided as an integrated component with the drain pan or as separate components from the drain pan.

13. The air-conditioning-apparatus indoor unit of claim 1, wherein the deflection-guide upper surface is a planar surface which is inclined obliquely with respect to a plane of the body-air-outlet outer side wall.

14. The air-conditioning-apparatus indoor unit of claim 1, wherein the deflection-guide upper surface is a planar surface.

* * * * *